US006695658B1

(12) United States Patent
Muramatsu

(10) Patent No.: US 6,695,658 B1
(45) Date of Patent: Feb. 24, 2004

(54) OIL TANK CONSTRUCTION FOR SMALL WATERCRAFT

(75) Inventor: Hitoshi Muramatsu, Shizuoka (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 10/112,836

(22) Filed: Mar. 29, 2002

(30) Foreign Application Priority Data

Dec. 7, 2001 (JP) ..... 2001-373759

(51) Int. Cl.[7] ..... B63H 21/38
(52) U.S. Cl. ..... 440/88 L; 123/572
(58) Field of Search ..... 440/88 R, 88 L; 184/6.8, 6.9; 123/572, 573, 574, 196 R, 196 A, 196 CP, 196 M, 196 W

(56) References Cited

U.S. PATENT DOCUMENTS

| | | | | | |
|---|---|---|---|---|---|
| 2,493,617 | A | * | 1/1950 | Chubbuck | 123/573 |
| 3,834,365 | A | * | 9/1974 | Ussery | 123/573 |
| 3,923,480 | A | * | 12/1975 | Visch | 96/360 |
| 4,184,858 | A | * | 1/1980 | Walker | 96/265 |
| 4,453,525 | A | * | 6/1984 | DeBruler | 123/573 |
| 4,549,520 | A | * | 10/1985 | Tamba et al. | 123/572 |
| 4,569,323 | A | * | 2/1986 | Okumura | 123/572 |
| 4,597,372 | A | * | 7/1986 | Furukawa | 123/572 |
| 4,790,287 | A | * | 12/1988 | Sakurai et al. | 123/573 |
| 4,945,887 | A | * | 8/1990 | Sakurai et al. | 123/573 |
| 5,005,553 | A | * | 4/1991 | Washizu et al. | 123/572 |
| 5,038,815 | A | * | 8/1991 | Palmer | 137/237 |
| 5,417,184 | A | * | 5/1995 | McDowell | 123/41.86 |
| 5,450,835 | A | * | 9/1995 | Wagner | 123/573 |
| 5,514,015 | A | * | 5/1996 | Okazawa et al. | 440/88 L |
| 5,537,959 | A | * | 7/1996 | Ito | 123/73 AD |
| 5,951,343 | A | | 9/1999 | Nanami et al. | |
| 5,996,561 | A | * | 12/1999 | Watanabe | 123/572 |
| 6,015,320 | A | | 1/2000 | Nanami | |
| 6,029,638 | A | * | 2/2000 | Funai et al. | 123/572 |
| 6,044,828 | A | * | 4/2000 | Matsushita | 123/572 |
| 6,058,917 | A | * | 5/2000 | Knowles | 123/573 |
| 6,412,478 | B1 | * | 7/2002 | Ruehlow et al. | 123/572 |
| 6,491,556 | B2 | * | 12/2002 | Muramatsu et al. | 440/88 R |

OTHER PUBLICATIONS

Application entitled, Cooling System for Small Watercraft, Application No.: 10/060866 filed Jan. 29, 2002, in 26 pages and 14 sheets of drawings.

Application entitled, Oil Pump Construction for Watercraft Engine, Application No.: 09/815421 filed on Mar. 22, 2001, in 27 pages and 23 sheets of drawings.

Application entitled, Cooling System for Land Vehicles, Application No.: 09/718820 filed on Nov. 22, 2000, in 25 pages and 9 sheets of drawings.

Application entitled, Engine Coding System for Watercraft, Application No.: 09/678409 filed on Oct. 2, 2000, in 23 pages and 6 sheets of drawings.

Application entitled, Lubricant Cooling System for Outboard Motor, Application No.: 09/417642 filed on Oct. 14, 1999, in 15 pages and 4 sheets of drawings.

* cited by examiner

*Primary Examiner*—S. Joseph Morano
*Assistant Examiner*—Ajay Vasudeva
(74) *Attorney, Agent, or Firm*—Knobbe, Martens, Olson & Bear, LLP

(57) ABSTRACT

A small watercraft engine having a lubrication system including a lubrication oil reservoir. In an upper portion of the reservoir, a breather assembly is mounted which aids in separating liquids from vapor traveling therethrough. A lower surface of the baffle arrangement includes at least one aperture which allows vapor from the main portion of the lubricant reservoir to pass upwardly into the breather arrangement. A skirt extends downwardly around the aperture so as to aid in preventing liquid lubricant from passing through the aperture.

13 Claims, 13 Drawing Sheets

OIL TANK CONSTRUCTION FOR SMALL WATERCRAFT

PRIORITY INFORMATION

This application is based on and claims priority to Japanese Patent Application No. 2001-373759, filed Dec. 7, 2001, the entire contents of which are hereby expressly incorporated by reference.

BACKGROUND OF THE INVENTION

1. Field of the Invention

The present invention is directed to a lubricant reservoir. More specifically, the present invention relates to an improved breather arrangement for a lubricant reservoir.

2. Description of Related Art

Personal watercraft have become very popular in recent years. This type of watercraft is quite sporting in nature and carries one or more riders. A relatively small hull of the personal watercraft defines a rider's area above an engine compartment. An internal combustion engine powers a jet propulsion unit which propels the watercraft. The engine lies within the engine compartment in front of a tunnel formed on an underside of the hull. The jet propulsion unit, which includes an impeller, is placed within the tunnel. The impeller has an impeller shaft driven by the engine. The impeller shaft usually extends between the engine and the jet propulsion device through a bulkhead of the hull tunnel.

Four-stroke engines include lubrication systems arranged to supply lubrication oil to various portions of their engines, such as the crankshaft chamber and camshaft chamber. Desirably, a volume of lubrication oil is provided within a reservoir to be available for supply to the engine. The lubrication oil is permitted to cool upon being returned to the reservoir before again being supplied to the engine. As the oil pools in the reservoir, blow by gasses and air that have been entrained in the oil, aspirate out of the oil and collect in the reservoir. Vapor conduits can connect the lubricant reservoir with an induction system of the engine so as to draw out and dispose of the air and/or blow-by gasses.

SUMMARY OF THE PREFERRED EMBODIMENTS

One aspect of the present invention includes the realization that vapor recovery arrangements in the lubricant reservoirs of some watercraft can ingest liquid oil during normal operation. For example, with reference to FIGS. 1 and 2, the lubricant reservoir and vapor recovery arrangement 10 of a personal watercraft (not shown) is illustrated therein. The reservoir assembly and vapor recovery arrangement 10 include a lubricant tank 12 which includes a reservoir portion 14 and the vapor separator portion 16.

The reservoir portion 14 includes an inlet 18 which receives liquid lubricant L from a pump (not shown). The reservoir portion 14 also includes an outlet 20 which guides lubricant L from the reservoir portion 14 to another pump (not shown).

The vapor separator portion 16 includes a baffle 22 mounted below an upper wall of the reservoir 12. A breather chamber 24 is defined between the baffle 22 on the upper walls of the reservoir 12. The baffle 22 includes a plurality of breather apertures 26.

A conduit 27 extends from a side of the reservoir to the head of the associated engine. The conduit 27 thus allows oil overflowing within the reservoir 12 to be returned to the engine body. Additionally, blow-by gases contained within the engine body can flow into the reservoir 12. A vapor recovery conduit 28 extends from an upper wall of the reservoir 12 to a second breather chamber 29. The second breather chamber 29 defines a labyrinth path therein. The outlet of the second breather chamber 29 is connected to the induction system (not shown) of the watercraft.

In normal operation, the level of liquid lubricant L within the reservoir 12 means substantially level, as shown on FIG. 1. As the engine (not shown) of the watercraft operates, liquid lubricant L travels up the inlet portion 18 and fills the reservoir portion 14. Because the liquid lubricant L becomes entrained with air and/or blow-by gases as it moves through the engine, the air and/or blow-by gases along with some oil vapor V aspirate out of the liquid lubricant L. The vapors V travel through the apertures 26 into the breather chamber 24. From the breather chamber 24, the vapors travel through the vapor conduit 28 through the second breather chamber 29. As the vapor V travels through the labyrinth path defined within the second breather chamber 29, additional liquids, such as liquid lubricant L, precipitates out of the vapor V. The second breather chamber 29 includes a drain which allows the liquid lubricant L to return to the crankcase of the engine. The vapors that travel through the second breather chamber 29 return to the induction system of the engine for combustion within the engine.

When the watercraft is operated at elevated speed, and in particular at planing speeds, the watercraft continually jumps out of the water to varying degrees. Additionally, personal watercraft are often turned sharply during operation. It has been found that jumping and turning movements of such a watercraft tend to cause the liquid lubricant L, within the reservoir 14 to travel upwardly along the sides of the reservoir 14 toward the apertures 26. As such, an excessive amount of liquid lubricant L, which can be in the form of large droplets, enters the first breather chamber 24, and thus can enter the vapor recovery line 28. Further, it has been found that enough liquid lubricant L can travel into the first breather chamber 24 so as to hinder the performance of vapor recovery and/or be drawn into the vapor recovery line 28.

According to another aspect of the present invention, a watercraft includes a hull into an engine disposed within the hull. The engine includes a lubrication and vapor recovery arrangement including a lubricant reservoir in the breather assembly within the reservoir. The breather assembly includes at least one baffle defining a breather chamber within a lubricant reservoir. The baffle includes at least one aperture allowing vapor from the lubricant reservoir to flow into the breather chamber. Additionally, a wall extends downwardly from a lower surface of the breather assembly, around the periphery of the at least one aperture.

By providing the wall disposed around the periphery of the aperture in the baffle, less oil can enter the breather chamber. For example, when the watercraft is operated at a planing speed which it jumps out of the water and/or operated through highspeed turns, lubricant is urged upwardly along the sides of the lubricant reservoir towards the apertures. As the lubricant travels up the sides of the walls and hits the baffle, the lubricant is turned inwardly towards the apertures. The wall disposed around the periphery of the aperture helps divert the liquid lubricant away from the apertures. Thus, the baffle arrangement according to the present invention helps prevent oil from entering the breather chamber and thus impeding the operation of the breather assembly.

Further aspects, features and advantages of this invention will become apparent from the detailed description of the preferred embodiments which follow.

BRIEF DESCRIPTION OF THE DRAWINGS

These and other features, aspects and advantages of the present invention will be described with reference to the drawings of preferred embodiments which are intended to illustrate and not to limit the invention. The drawings comprise 31 figures.

DETAILED DESCRIPTION OF PREFERRED EMBODIMENTS OF THE INVENTION

With reference to FIGS. 3 to 7, an overall configuration of a personal watercraft 30 will be described to assist the reader's understanding of a preferred environment of use. The watercraft 30 will be described in reference to a coordinate system wherein a longitudinal axis extends from bow to stem and a lateral axis from port side to starboard side normal to the longitudinal axis. The longitudinal axis lies in a vertical, central plane CP of the watercraft 30. In addition, relative heights are expressed as elevations in reference to the under surface of the watercraft 30. In various figures, an arrow denoted with the legend "forward" is used to denote the direction in which the watercraft travels during normal forward operation.

The watercraft 30 employs an internal combustion engine 32 configured in accordance with a preferred embodiment of the present invention. The described engine configuration has particular utility with the personal watercraft, and thus, is described in the context of the personal watercraft. The engine configuration, however, can be applied to other types of water vehicles as well, such as, for example, small jet boats.

Figure 5:
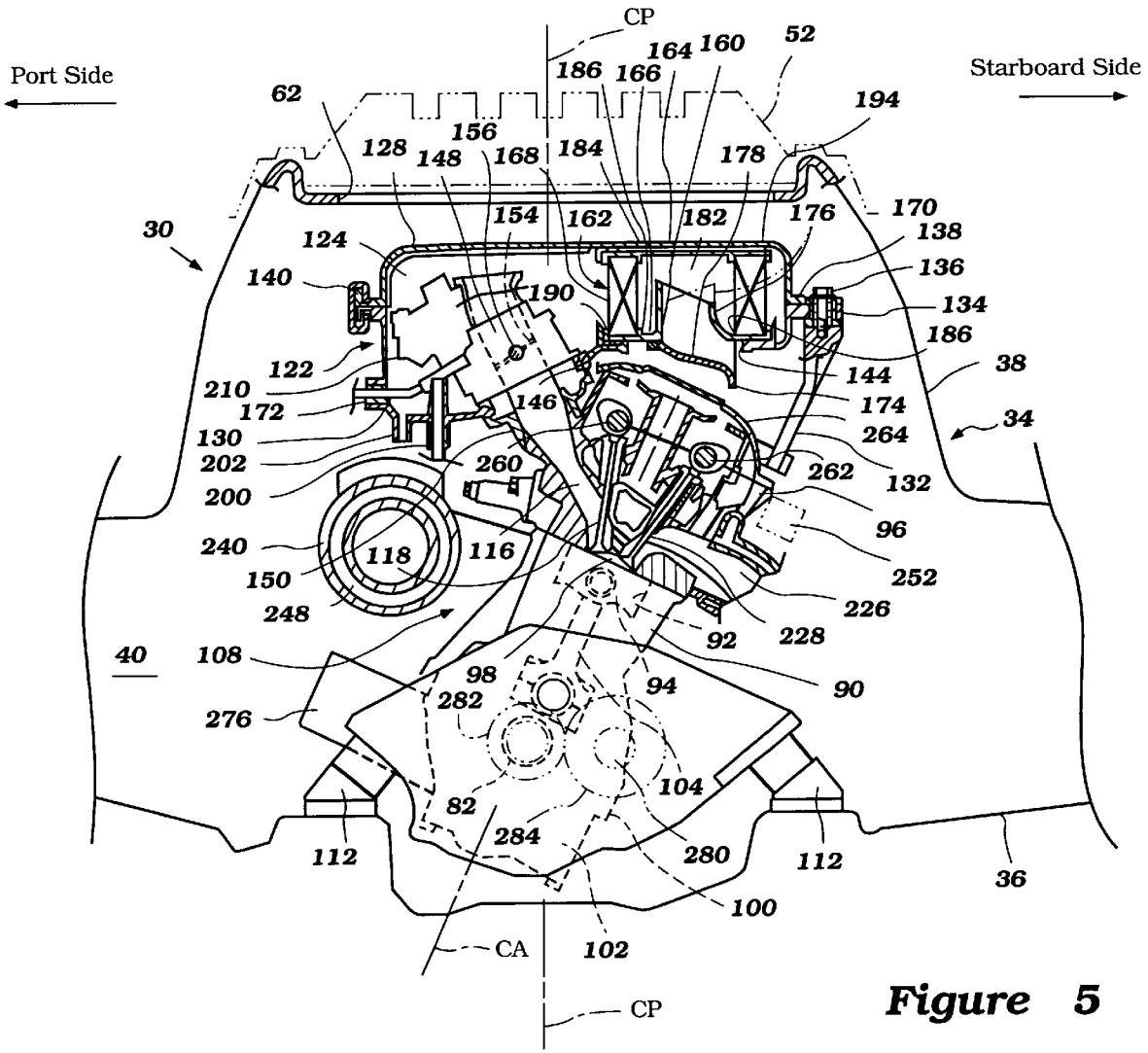
FIG. 5 is a partial cross-sectional view from the rear of the watercraft of FIG. 1, a hull of the watercraft is illustrated schematically.

The personal watercraft 30 includes a hull 34 formed with a lower hull section 36 and an upper hull section or deck 38. Both the hull sections 36, 38 are made of, for example, a molded fiberglass reinforced resin or a sheet molding compound. The lower hull section 36 and the upper hull section 38 are coupled together to define an internal cavity 40 (FIG. 5). A bond flange 42 defines an intersection of both the hull sections 36, 38. Alternatively, the hull 34 may have a unitary construction.

Figure 1:
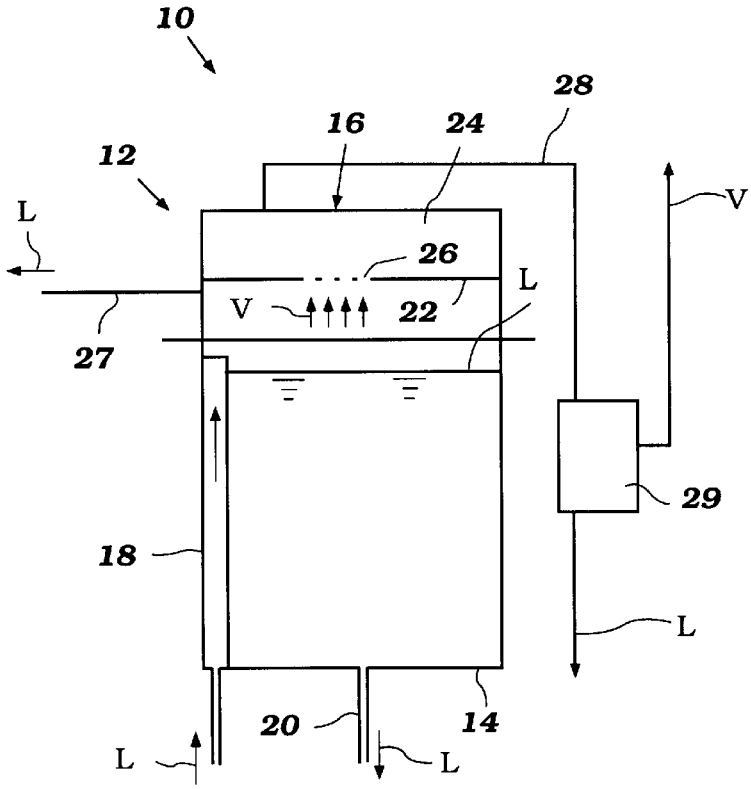
FIG. 1 is a schematic view of a lubricant reservoir and vapor recovery assembly of a personal watercraft.
Figure 2:
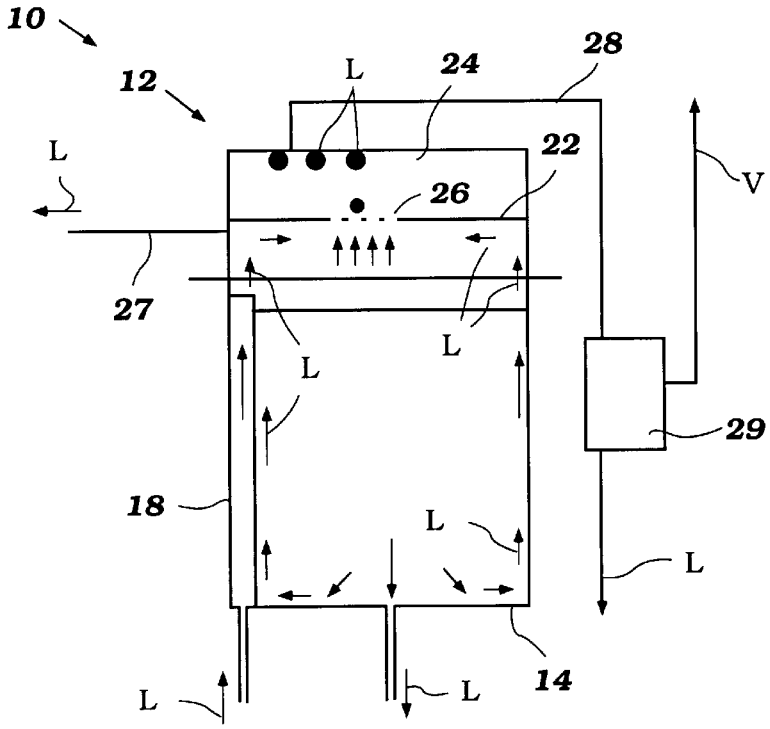
FIG. 2 is a further schematic view of the lubricant reservoir and vapor recovery assembly shown on FIG. 1, illustrating the movement of liquid lubricant within the reservoir during operation of the associated watercraft.
Figure 3:
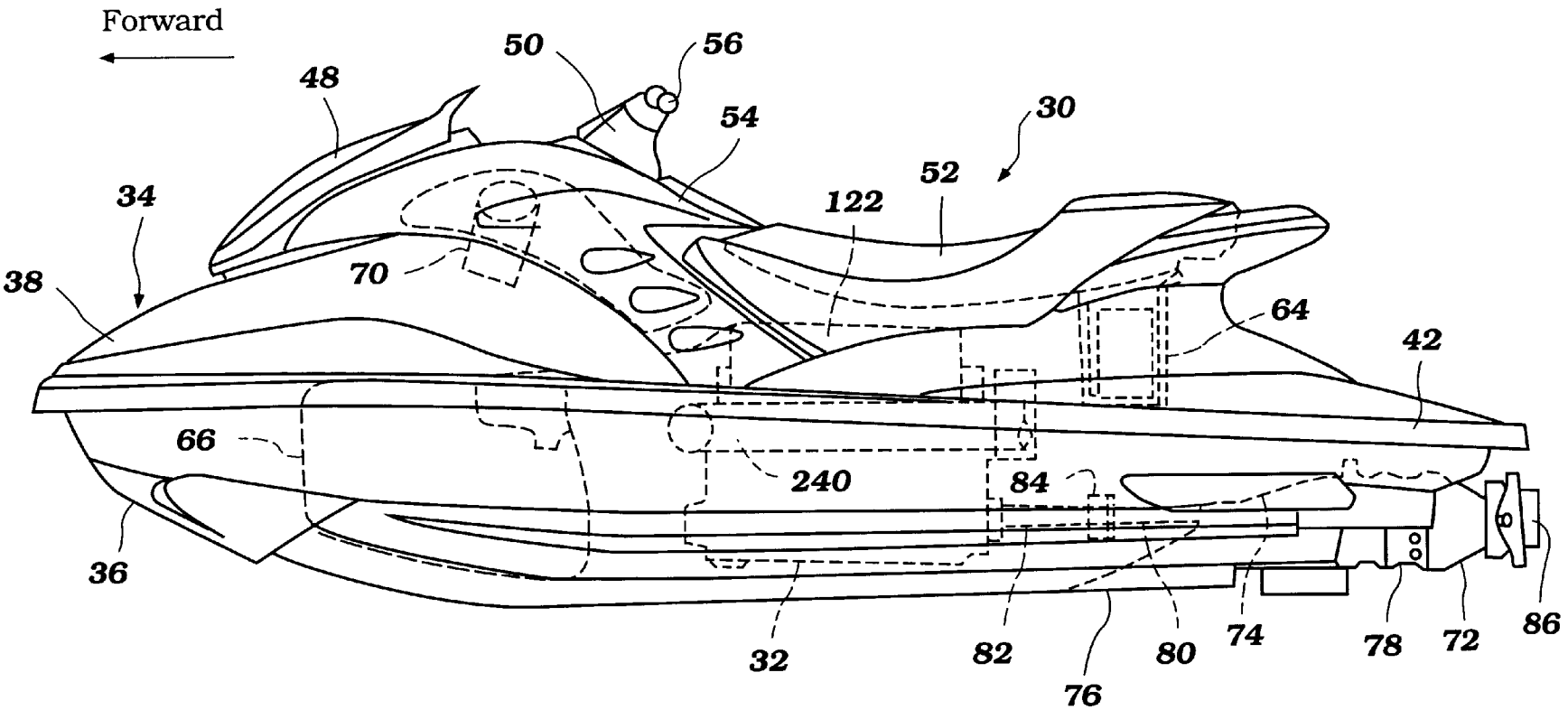
FIG. 3 is a side elevational view of a small watercraft with several internal components (e.g., an engine) shown in phantom.
Figure 4:
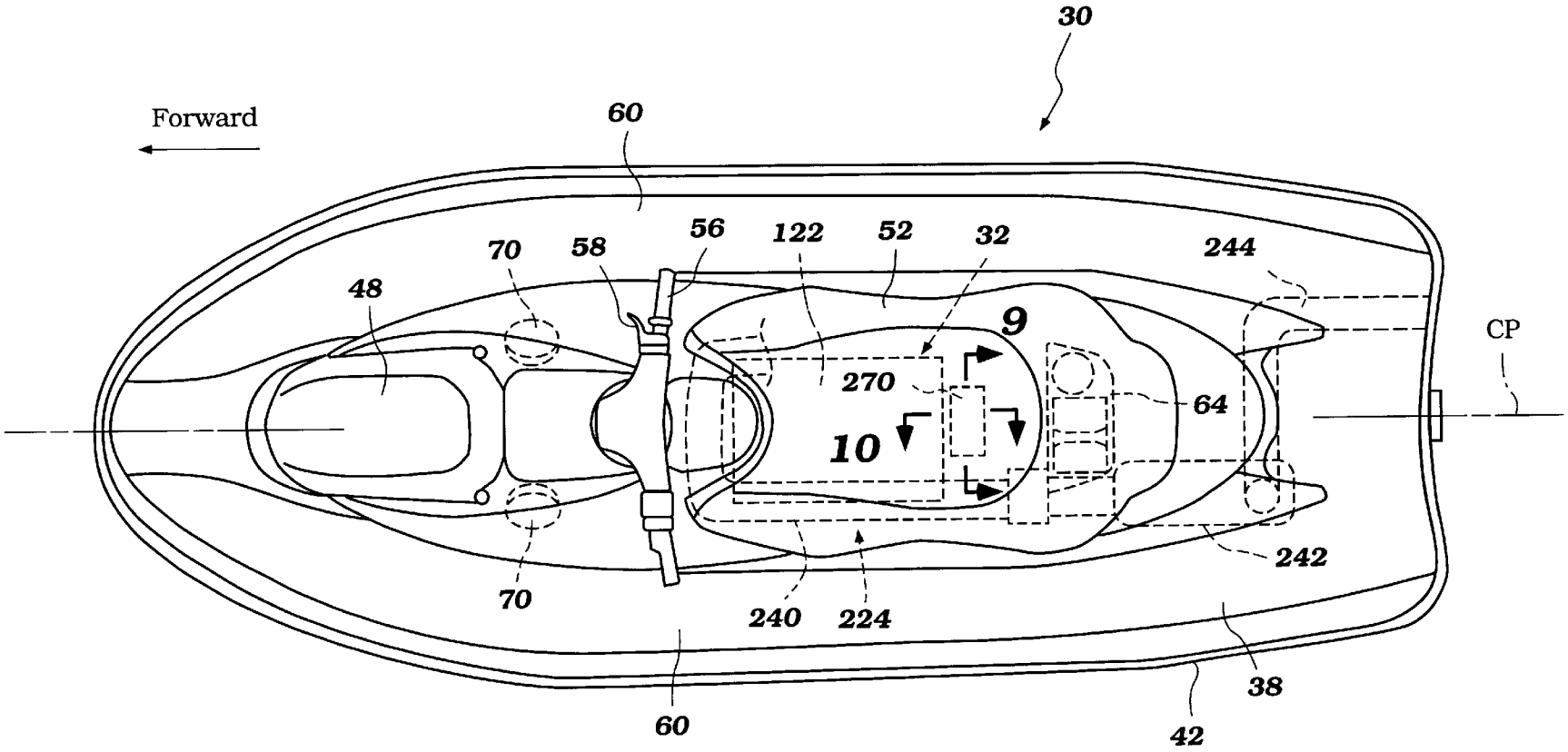
FIG. 4 is a top, plain view of the watercraft at FIG. 1.

With reference to FIGS. 4 and 5, a center plane CP that extends generally vertically from a bow to a stern of the watercraft 30. Along the center plane CP, the upper hull section 34 includes a hatch cover 48, a control mast 50 and a seat 52 arranged from fore to aft.

In the illustrated embodiment, a bow portion 54 of the upper hull section 38 slopes upwardly and an opening (not shown) preferably is provided through which the rider can access the internal cavity 40. The bow portion 54 preferably is provided with a pair of cover member pieces which are apart from one another along the center plane CP. The hatch cover 48 is detachably affixed (e.g., hinged) to the bow portion 54 so as to cover the opening.

The control mast 50 extends upwardly to support a handle bar 56. The handle bar 56 is provided primarily for controlling the directions in which the water jet propels the watercraft 30. Grips are formed at both ends of the bar 56 so that the rider can hold them for that purpose. The handle bar 56 also carries other control units such as, for example, a throttle lever 58 that is used for control of running conditions of the engine 32.

The seat 52 extends along the center plane CP to the rear of the bow portion 54. The seat 52 also generally defines a rider's area. The seat 52 has a saddle shape and hence a rider can sit on the seat 52 in a straddle-type fashion. Foot areas 60 are defined on both sides of the seat 52 and at the top surface of the upper hull section 38. The foot areas 60 are formed generally flat. A cushion supported by the upper hull section 38, at least in principal part, forms the seat 52. The seat 52 is detachably attached to the upper hull section 38. An access opening 62 is defined under the seat 52 through which the rider can also access the internal cavity 40. That is, the seat 52 usually closes the access opening 62. In the illustrated embodiment, a storage box 64 is disposed under the seat 52.

A fuel tank 66 is placed in the cavity 40 under the bow portion 54 of the upper hull section 38. The fuel tank 66 is coupled with a fuel inlet port positioned at a top surface of the upper hull section 38 through a duct (not shown). A closure cap (not shown) closes the fuel inlet port. The opening disposed under the hatch cover 48 is available for accessing the fuel tank 66.

The engine 32 is disposed in an engine compartment defined in the cavity 40. The engine compartment preferably is located under the seat 52, but other locations are also possible (e.g., beneath the control mast or in the bow). The rider thus can access the engine 32 in the illustrated embodiment through the access opening 62 by detaching the seat 52.

A pair of air ducts or ventilation ducts 70 are provided on both sides of the bow portion 54 so that the ambient air can enter and exit the internal cavity 40 therethrough. Except for the air ducts 70, the engine compartment is substantially sealed so as to protect the engine 32 and other components from water.

A jet pump unit 72 propels the watercraft 30. The jet pump unit 72 includes a tunnel 74 formed on the underside of the lower hull section 36 which is isolated from the engine compartment by a bulkhead. The tunnel 74 has a downward facing inlet port 76 opening toward the body of water. A jet pump housing 78 is disposed within a portion of the tunnel 74 and communicates with the inlet port 76. An impeller is supported within the housing 78.

An impeller shaft 80 extends forwardly from the impeller and is coupled with a crankshaft 82 of the engine 32 by a coupling member 84. The crankshaft 82 of the engine 32 thus drives the impeller shaft 80. Although the impeller shaft 80 is illustrated as a single shaft, it may nonetheless be comprised of two or more shaft portions coupled to one another. Preferably, the impeller shaft 80 includes a first shaft coupled to the impeller 79 and a second shaft connecting the first impeller shaft to the crankshaft 82.

The rear end of the housing 78 defines a discharge nozzle. A steering nozzle 86 is affixed to the discharge nozzle for pivotal movement about a steering axis extending generally vertically. The steering nozzle 86 is connected to the handle bar 56 by a cable so that the rider can pivot the nozzle 86.

As the engine 32 drives the impeller shaft 80 and hence rotates the impeller, water is drawn from the surrounding body of water through the inlet port 76. The pressure generated in the housing 78 by the impeller produces a jet of water that is discharged through the steering nozzle 86. This water jet propels the watercraft 30. The rider can move the steering nozzle 86 with the handle bar 56 when he or she desires to turn the watercraft 30 in either direction.

The illustrated engine 32 operates on a four-stroke cycle combustion principle. With reference to FIG. 5, the engine 32 includes a cylinder block 90. The cylinder block 90 defines four cylinder bores 92 aligned with each other from fore to aft along the center plane CP. The engine 32 thus is an L4 (in-line four cylinder) type. The illustrated engine, however, merely exemplifies one type of engine on which various aspects features of the present invention can be used. Engines having other number of cylinders, having other cylinder arrangements, other cylinder orientations (e.g., upright cylinder banks, V-type, and W-type) and operating on other combustion principles (e.g., crankcase compression two-stroke, diesel, and rotary) are all practicable.

Each cylinder bore 92 has a center axis CA that is slanted or inclined at an angle from the center plane CP so that the engine 32 can be shorter in height. All the center axes CA in the illustrated embodiment are inclined at the same angle.

Pistons 94 reciprocate within the cylinder bores 92. A cylinder head member 96 is fixed to the upper end of the cylinder block 90 to close respective upper ends of the cylinder bores and defines combustion chambers 98 with the cylinder bores 92 and the pistons 94.

A crankcase member 100 is affixed to the lower end of the cylinder block 90 to close the respective lower ends of the cylinder bores 92 and to define a crankcase chamber 102. The crankshaft 82 is rotatably connected to the pistons 94 through connecting rods 104 and is journaled by several bearings 106 formed on the crankcase member 100. That is, the connecting rods 104 are rotatably coupled with the pistons 94 and with the crankshaft 82.

The cylinder block 90, the cylinder head member 96 and the crankcase member 100 together define an engine body 108. The engine body 108 preferably is made of an aluminum based alloy. In the illustrated embodiment, the engine body 108 is oriented in the engine compartment so as to position the crankshaft 82 generally parallel to the central plane CP and to extend generally in the longitudinal direction. Other orientations of the engine body, of course, are also possible (e.g., with a transverse or vertical oriented crankshaft).

Engine mounts 112 extend from both sides of the engine body 108. The engine mounts 112 preferably include resilient portions made of, for example, a rubber material. The engine 32 preferably is mounted on the lower hull section 36, and specifically, on a hull liner, by the engine mounts 112 so that vibrations from the engine 32 are attenuated.

The engine 32 preferably includes an air induction system configured to guide air to the combustion chambers 98. In the illustrated embodiment, the air induction system includes four air intake ports 116 (one shown) defined in the cylinder head member 96. The intake ports 116 communicate with the associated combustion chambers 98. Intake valves 118 are provided to selectively connect and disconnect the intake ports 116 with the combustion chambers 98. That is, the intake valves 118 selectively open and close the intake ports 116.

The air induction system also includes an air intake box 122 or a "plenum chamber" for smoothing intake air and acting as an intake silencer. The intake box 122 in the illustrated embodiment is generally rectangular in top plan view and defines a plenum chamber 124. Other shapes of the intake box of course are possible, but it is desired to make the plenum chamber as large as possible within the space provided in the engine compartment. In the illustrated embodiment, a space is defined between the top of the engine 32 and the bottom of the seat 52 due to the inclined orientation of the engine 32. The rectangular shape of at least a principal portion of the intake box 122 conforms to this space.

Figure 6:
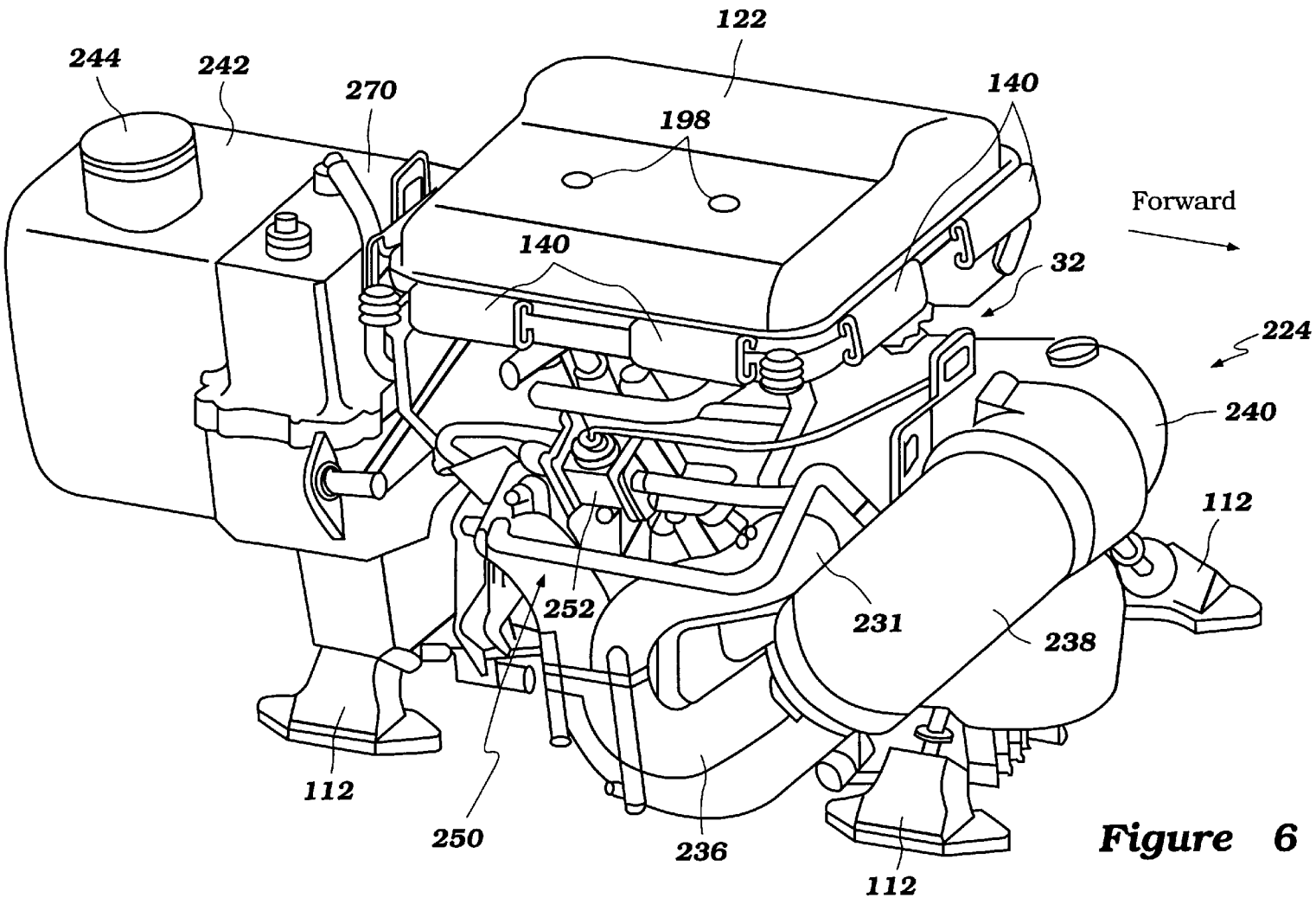
FIG. 6 is a top, front and starboard side perspective view of the engine shown in FIG. 5.
Figure 7:
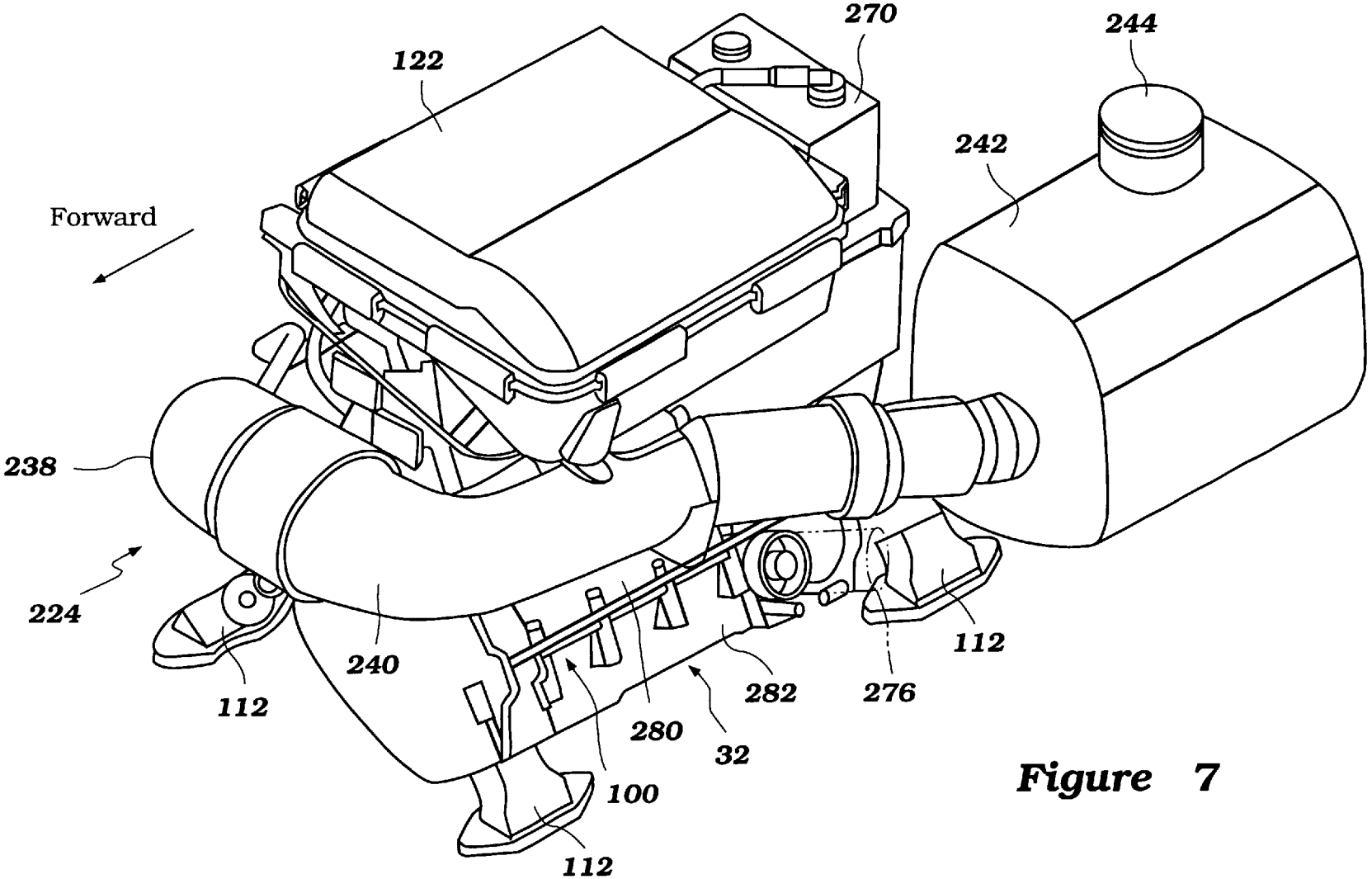
FIG. 7 is a top, front, and port side perspective view of the engine shown in FIG. 5.

With reference to FIGS. 5–7, the intake box 122 comprises an upper chamber member 128 and a lower chamber member 130. The upper and lower chamber members 128, 130 preferably are made of plastic or synthetic resin, although they can be made of metal or other material. While the illustrated intake box 122 is formed by upper and lower chamber members, the chamber member can be formed by a different number of members and/or can have a different assembly orientation (e.g., side-by-side).

With reference to FIG. 5, the lower chamber member 130 preferably is coupled with the engine body 108. In the illustrated embodiment, several stays 132 (one shown) extend upwardly from the engine body 108, a flange portion 134 of the lower chamber member 130 extends generally horizontally. Several fastening members, for example, bolts 136, rigidly affix the flange portion 134 to respective top surfaces of the stays 132.

The upper chamber member 128 has a flange portion 138 that abuts the flange portion 134 of the lower member 130. Several coupling or fastening members 140, which are generally configured as a shape of the letter "C" in section, preferably put both the flange portions 134, 138 therebetween so as to couple the upper chamber member 128 with the lower chamber member 130. The intake box 122 thus is laid in a space defined between the engine body 108 and the seat 52, i.e., the rider's area of the hull 34, so that the plenum chamber 124 defines a relatively large volume therein.

The lower chamber member 130 defines an inlet opening 144 and four outlet apertures 146 (one shown). Four throttle bodies 148 (one shown) extend through the apertures 146 and preferably are fixed to the lower chamber member 130. Respective bottom ends of the throttle bodies 148 are coupled with the associated intake ports 116. Preferably, the position at which the apertures 146 are sealed to the throttle bodies 148 are spaced from the outlet of "bottom" ends of the throttle bodies 148. Thus, the lower member 130 is spaced from the engine 32, thereby attenuating transfer of heat from the engine body 108 into intake box 122.

Preferably, the throttle bodies 148 slant toward the port side oppositely the center axis CA of the engine body 108. A rubber boot 150 extends between the lower chamber member 130 and the cylinder head member 96 so as to generally surround a portion of the throttle bodies 148 which extend out of the plenum chamber 124. Respective top ends of the throttle bodies 148, in turn, open upwardly within the plenum chamber 124. Air in the plenum chamber 124 thus is drawn to the combustion chambers 98 through the throttle bodies 148 and the intake ports 116 when negative pressure is generated in the combustion chambers 98. The negative pressure is generated when the pistons 94 move toward the bottom dead center from the top dead center.

Each throttle body 148 includes a throttle valve 154 (one shown). A throttle valve shaft 156 journaled for pivotal movement, links the entire throttle valves 154. Pivotal movement of the throttle valve shaft 156 is controlled by the throttle lever 58 on the handle bar 56 through a control cable that is connected to the throttle valve shaft 156. The control cable can extends into the intake box 122 through a throughhole 172 defined at a side surface of the lower chamber member 130. The rider thus can control opening amount of the throttle valves 154 by operating the throttle lever 56 so as to obtain various running conditions of the engine 32 that the rider desires. That is, an amount of air passing through the throttle bodies 148 is controlled by this mechanism and delivered to the respective combustion chambers 98. In order to sense positions of the throttle valves 154, a throttle valve position sensor (not shown) preferably is provided at one end of the throttle valve shaft 156.

Air is introduced into the plenum chamber 124 through a pair of air inlet ports 160. In the illustrated embodiment, a filter assembly 162 separates the inlet ports 160 from the plenum chamber 124. The filter assembly 162 comprises an upper plate 164, a lower plate 166 and a filter element 168 interposed between the upper and lower plates 164, 166.

The lower plate 166 includes a pair of ducts 170 (one shown) extending inwardly toward the plenum chamber 124. The ducts 170 form the inlet ports 160. The ducts 170 are positioned generally above the cylinder head member 96. Upper ends of the ducts 170 slant so as to face an inner wall portion of the intake box 122 existing opposite the throttle bodies 148. In the illustrated embodiment, the upper or inlet ends of the ducts 170 define a high point proximate to the outlet apertures 146 and a low point distal from the apertures 146. This is advantageous because water or water mist, if any, is likely to move toward this inner wall portion rather than toward the throttle bodies 148. If, however, a smooth flow of air is desired more than the water inhibition, the upper ends of the ducts 170 can slant toward the throttle bodies 148 as indicated by the phantom line of FIG. 5.

In the illustrated embodiment, a guide member 174 is affixed to the lower plate 166 immediately below the ducts 170, preferably by several screws (not shown). The guide member 174 defines a pair of recesses 178 that are associated with the respective ducts 170. The recesses 178 open toward the starboard side. The air in the cavity 40 of the engine compartment thus is drawn into the plenum chamber 124 along the recesses 178 of the guide member 174 and then through the ducts 170.

The filter assembly 162 including the lower plate 166 is generally rectangular in shape in a plan view. The filter element 168 extends along a periphery of the rectangular shape so as to have a certain thickness from a peripheral edge. The ducts 170 open to a hollow 182 defined by the filter element 168. The air in this hollow 182 thus cannot reach the throttle bodies 148 without passing through the filter element 168. Foreign substances in the air are removed by the filter element 168 accordingly.

Preferably, outer projections 184 and inner projections 186 are formed on respective opposite surfaces of the upper and lower plates 164, 166 to fixedly support the filter element 168 therebetween. The outer projections 184 extend along the outermost edges of the plates 164, 166, and the inner projections 186 extend generally parallel to the outer projections 184 at a distance slightly larger than the thickness of the filter element 168.

The filter assembly 162 in turn is also fixedly supported by the lower and upper chamber members 130, 128. The lower chamber member 130 has a projection 190 extending toward the upper chamber member 128 and around the inlet opening 144. This projection 190 prevents the filter assembly 162 from slipping off the opening 144.

In addition, the upper chamber member 128 preferably has a plurality of ribs (not shown) extending toward the lower chamber member 130, parallel to each other. Tip portions of the respective ribs abut on an upper surface of the upper plate 164. Because a distance between the tip portions of the ribs and the lower chamber plate 130 is slightly less than a distance between the upper surface of the upper plate 164 and a lower surface of the lower plate 166, the filter assembly 162 can be securely interposed between the upper and lower chamber members 128, 130 when the upper chamber member 164 is affixed to the lower chamber member 130 by the coupling members 140.

A plurality of seal members 194 preferably are positioned at outer periphery portions of the upper and lower plates 164, 166 so as to be interposed between the respective chamber members 128, 130 and the respective plates 164, 166. Thereby, the members 128, 130, can be sealedly engaged with each other. However, any known technique can be used to form a sealed engagement between the members 128, 130, such as, for example, but without limitation, gaskets, o-rings, tongue and groove joints, adhesives and the like. Thus, air is allowed to enter the plenum chamber 124 only through the air inlet ports 160.

With reference to FIG. 6, the upper chamber member 128 preferably is fixed to the lower chamber member 130 by a pair of bolts 198 which extend through bolt holes (not shown) of the upper chamber member 128 and bolt holes (not shown) of the lower chamber member 130. This additional fixing is advantageous not only for the rigid coupling of these chamber members 128, 130 but also for inhibiting noise from occurring by vibration of the upper chamber member 128.

Because the air inlet ports 160 are formed at the bottom of the intake box 122, water and/or other foreign substances are unlikely to enter the plenum chamber 124. Additionally, the filter element 168 further prevents water and foreign particles from entering the throttle bodies 148. In addition, the pair of inlet ports 160 are defined by the ducts 170 extending into the plenum chamber 124. Thus, a desirable length for efficient silencing of intake noise can be accommodated within the plenum chamber 128.

Additionally, the lower chamber member 130 of the intake box 122 may include a blow-by gas inlet port 200 next to one of the apertures 148 through which the throttle bodies 148 extend. The blow-by gas inlet port 200 may be connected to the crankcase chamber 102 to permit blow-by gases (i.e., gases which may pass from the combustion chambers 98, past the pistons 92, and into the crankcase chamber 102 due to the extremely high pressures generated during combustion) to be reintroduced to the air intake system. The inlet port 200 may also be connected to other portions of the engine 32, such as the lubrication system, as is described in detail below.

A water discharge hole 202 preferably is provided in close proximity to the inlet port 200 to discharge water accumulating in the plenum chamber 124. The water discharge hole 202 can have a one-way valve (i.e., check valve) that allows the accumulating water to move out but inhibits water existing outside from entering.

The engine 32 also includes a fuel supply system configured to supply fuel for combustion in the combustion chambers 98. The fuel supply system includes the fuel tank 66 (FIG. 3) and fuel injectors 210 that are affixed to a fuel rail (not shown) which are mounted on the throttle bodies 148. The fuel rail extends generally horizontally in the longitudinal direction. A fuel inlet port (not shown) is defined at a forward portion of the lower chamber member 130 so that the fuel rail 212 is coupled with an external fuel passage.

Because the throttle bodies 148 are disposed within the plenum chamber 124, the fuel injectors 210 are also desirably positioned within the plenum chamber 124. However, other types of fuel injector can be used which are not mounted in the intake box 124, such as, for example, but without limitation, direct fuel injectors and induction passage fuel injectors connected to the scavenge passages of two-cycle engines.

Electrical cables for the fuel injectors 210 enter the intake box 122 through the through-hole 172 with the control cable of the throttle shaft 156. Each fuel injector 210 has an injection nozzle directed toward the intake port 116 associated with each fuel injector 210.

The fuel supply system also includes a low-pressure fuel pump (not shown), a vapor separator (not shown), a high-pressure fuel pump (not shown) and a pressure regulator (not shown), in addition to the fuel tank 66, the fuel injectors 210 and the fuel rail. Fuel supplied from the fuel tank 66 is pressurized by the low pressure fuel pump and is delivered to the vapor separator in which the fuel is separated from fuel vapors. One or more high pressure fuel pumps draw the fuel from the vapor separator and pressurize the fuel before it is delivered to the fuel rail. The pressure regulator controls the pressure of the supplied fuel, i.e., limits the fuel pressure to a preset pressure level. The fuel rail can be configured to support the fuel injectors 210 as well as deliver the fuel to the respective fuel injectors 210.

The fuel injectors 210 spray the fuel into the intake ports 116 at an injection timing and duration under control of an ECU (Electronic Control Unit) (not shown). The ECU can control the injection timing and duration according to any known control strategy which preferably refers to a signal from at least one engine sensor, such as, for example, but without limitation, the throttle valve position sensor.

The sprayed fuel is delivered to the combustion chambers 98 with the air when the intake ports 116 are opened to the combustion chambers 98 by the intake valves 118. The air and the fuel are mixed together to form air/fuel charges which are then combusted in the combustion chambers 98.

Figure 8:
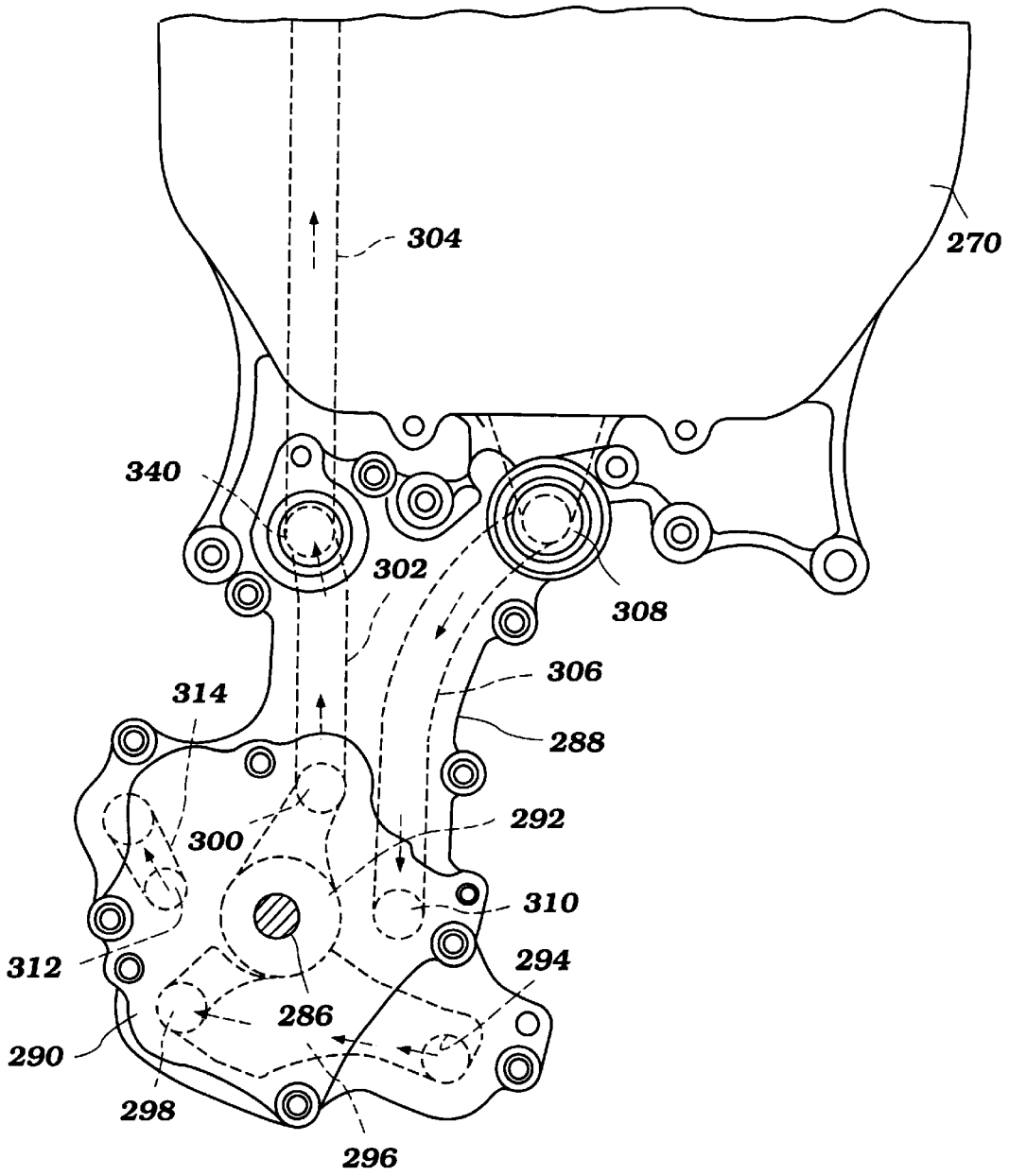
FIG. 8 is an enlarged rear elevational view of the engine shown in FIG. 5, illustrating an oil pump cover assembly and a lower portion of a lubricant reservoir of the watercraft shown in FIG. 3.

With reference to FIG. 8, the ECU may be housed within a electrical component box 214, along with other electrical components of the engine 32. The box 214 may be attached to a portion of the watercraft 30, such as an internal wall, or bulkhead 214*a*. Components within the box 214 may be in electric communication with a connector 214*b*, through connections 214*c*, 214*d*. Sensors of the engine 32 may be connected to connector 214*b* to communicate with components within the box 214. Preferably, a rectifier 216 is position within the connection 214*c*, between the components within the box 214 and the connector 214*b*.

The engine 32 further includes a firing or ignition system. In the illustrated engine 32, four spark plugs (not shown) are affixed to the cylinder head member 96 so that electrodes, which are defined at one ends of the plugs, are exposed to the respective combustion chambers 98. Plug caps are detachably coupled with the other ends of the spark plugs and have electrical connection with the plugs. Electric power is supplied to the plugs through power cables and the plug caps. The spark plugs are fired at an ignition timing under control of the ECU. The air/fuel charge is combusted during every combustion stroke accordingly.

With reference to FIGS. 5–7, the engine 32 further includes an exhaust system 224 to guide burnt charges, i.e., exhaust gases, from the combustion chambers 98. In the illustrated embodiment, with reference to FIG. 5, the exhaust system 224 includes four exhaust ports 226 (one shown). The exhaust ports 226 are defined in the cylinder head member 96 and communicate with the associated combustion chambers 98. Exhaust valves 228 are provided to selectively connect and disconnect the exhaust ports 226 with the combustion chambers 98. That is, the exhaust valves 228 selectively open and close the exhaust ports 226.

As illustrated in FIGS. 6 and 7, the exhaust system includes an exhaust manifold 231. In a presently preferred embodiment, the manifold 231 comprises a first exhaust manifold and a second exhaust manifold coupled with the exhaust ports 226 on the starboard side to receive exhaust gases from the respective ports 226. The first exhaust manifold is connected with two of the exhaust ports 226 and the second exhaust manifold is connected with the other two exhaust ports 226. In a presently preferred embodiment, the first and second exhaust manifolds are configured to nest with each other.

A downstream end of the exhaust manifold 231 is coupled with a first unitary exhaust conduit 236. The first unitary conduit 236 is further coupled with a second unitary exhaust conduit 238. The second unitary conduit 238 is then coupled with an exhaust pipe 240 on the rear side of the engine body 108.

The exhaust pipe 240 extends rearwardly along a side surface of the engine body 108 on the port side. The exhaust pipe 240 is then connected to a water-lock 242 at a forward surface of the water-lock 242. With reference to FIG. 4, a discharge pipe 244 extends from a top surface of the water-lock 242 and transversely across the center plane CP. The discharge pipe 244 then extends rearwardly and opens at a stern of the lower hull section 36 in a submerged position. The water-lock 242 inhibits the water in the discharge pipe 244 from entering the exhaust pipe 240.

The engine 32 further includes a cooling system configured to circulate coolant into thermal communication with at least one component within the watercraft 30. Preferably, the cooling system is an open type cooling system, circulating water from the body of water in which the watercraft 30 is operating, into thermal communication with heat generating components within the watercraft 30. However, other types of cooling systems can be used, such as, for example, but without limitation, closed-type liquid cooling systems using lubricated coolants and air-cooling types.

The cooling system includes a water pump arranged to introduce water from the body of water surrounding the watercraft 30, and a plurality of water jackets defined, for example, in the cylinder block 90 and the cylinder head member 96. The jet propulsion unit preferably is used as the water pump with a portion of the water pressurized by the impeller being drawn off for the cooling system, as known in the art. Although the water is primarily used for cooling these engine portions, part of the water is used also for cooling the exhaust system 224. That is, the engine 32 has at least an engine cooling system and an exhaust cooling system. The water directed to the exhaust cooling system preferably passes through a separate passage apart from the passage connected to the engine cooling system. The exhaust components 231, 236, 238 and 240 are formed as dual passage structures in general. More specifically, a water jacket 248 is defined around respective exhaust passages wherein cooling water is circulated, thereby cooling the exhaust system 224.

With reference to FIGS. 5 and 6, the engine 32 preferably includes a secondary air supply system 250 that supplies air from the air induction system to the exhaust system 224. More specifically, for example, hydro carbon (HC) and carbon monoxide (CO) components of the exhaust gases can be removed by an oxidation reaction with oxygen ($O_2$) that is supplied to the exhaust system 224 from the air induction system.

A secondary air supply device 252 is disposed next to the cylinder head member 96 on the starboard side. The air supply device 252 defines a closed cavity and contains a control valve therein. The air supply device 252 is affixed to the engine body 108, preferably together with one of the stays 132 that supports the air intake box 122. A single upstream air conduit extends from the lower chamber member 130 to a lower portion of the air supply device 252, and four downstream air conduits extend from the air supply device 252 to the exhaust manifold 231. That is, the respective downstream conduits are allotted to respective passages of the manifold 231. In addition, a vacuum line extends from a top portion of the air supply device 252 to one of the air intake ports 116.

The control valve controls a flow of air from the upstream conduit toward the downstream conduits in accordance with a condition of the negative pressure. If the negative pressure is greater than a predetermined negative pressure, the control valve permits the air flow to the downstream conduits. However, if the negative pressure is less than the predetermined negative pressure, then the control valve precludes the air from flowing to the downstream conduits. Air supplied from the air supply device 252 thus allows air to pass to the exhaust system preferably under a relatively high speed and/or high load condition because greater amounts of hydrocarbon (HC) and carbon monoxide (CO) are more likely to be present in the exhaust gases under such a condition.

With reference to FIG. 5, the engine 32 has a valve cam mechanism for actuating the intake and exhaust valves 118, 228. In the illustrated embodiment, a double overhead camshaft drive is employed. That is, an intake camshaft 260 actuates the intake valves 118 and an exhaust camshaft 262 separately actuates the exhaust valves 228. The intake camshaft 260 extends generally horizontally over the intake valves 118 from fore to aft in parallel to the center plane CP, and the exhaust camshaft 262 extends generally horizontally over the exhaust valves 228 from fore to aft also in parallel to the center plane CP.

Both the intake and exhaust camshafts 260, 262 are journaled by the cylinder head member 96 with a plurality of camshaft caps. The camshaft caps holding the camshafts 260, 262 are affixed to the cylinder head member 96. A cylinder head cover member 264 extends over the camshafts 260, 262 and the camshaft caps, and is affixed to the cylinder head member 96 to define a camshaft chamber.

The intake camshaft 260 has cam lobes each associated with a respective intake valve 118, and the exhaust camshaft 262 also has cam lobes associated with a respective exhaust valve 228. The intake and exhaust valves 118, 228 normally close the intake and exhaust ports 116, 226 by a biasing force of springs. When the intake and exhaust camshafts 260, 262 rotate, the cam lobes push the respective valves 118, 228 to open the respective ports 116, 228 by overcoming the biasing force of the spring. The air thus can enter the combustion chambers 98 when the intake valves 118 open. Similarly, the exhaust gases can move out from the combustion chambers 98 when the exhaust valves 228 open.

The crankshaft 82 preferably drives the intake and exhaust camshafts 260, 262. The respective camshafts 260, 262 have driven sprockets (not shown), affixed to ends thereof. The crankshaft 82 also has a drive sprocket (not shown). Each driven sprocket has a diameter which is twice as large as a diameter of the drive sprocket. A timing chain (not shown) or belt is wound around the drive sprocket and driven sprockets. When the crankshaft 82 rotates, the drive sprocket drives the driven sprockets via the timing chain, and thus the intake and exhaust camshafts 260, 262 also rotate. The rotational speed of the camshafts 260, 262 are reduced to half the rotational speed of the crankshaft 82 because of the differences in diameters of the drive sprocket and driven sprockets.

In operation, ambient air enters the internal cavity 40 defined in the hull 34 through the air ducts 70. The air is then introduced into the plenum chamber 124 defined by the intake box 122 through the air inlet ports 160 and drawn into the throttle bodies 148. The air filter element 168, which preferably comprises a water-repellent element and an oil resistant element, filters the air. The majority of the air in the plenum chamber 124 is supplied to the combustion chambers 98. The throttle valves 154 in the throttle bodies 148 regulate an amount of the air permitted to pass to the combustion chambers 98. The opening angles of the throttle valves 154 are controlled by the rider with the throttle lever 58 and thus controls the airflow across the valves. The air hence flows into the combustion chambers 98 when the intake valves 118 open. At the same time, the fuel injectors 210 spray fuel into the intake ports 116 under the control of ECU. Air/fuel charges are thus formed and delivered to the combustion chambers 98.

The air/fuel charges are fired by the spark plugs under the control of the ECU. The burnt charges, i.e., exhaust gases, are discharged to the body of water surrounding the watercraft 30 through the exhaust system 224. A relatively small amount of the air in the plenum chamber 124 is supplied to the exhaust system 224 through the secondary air supply system 250 so as to aid in further combustion of any unburned fuel remaining in the exhaust gases.

The combustion of the air/fuel charges causes the pistons 94 to reciprocate and thus causes the crankshaft 82 to rotate. The crankshaft 82 drives the impeller shaft 80 and the impeller rotates in the hull tunnel 74. Water is thus drawn into the tunnel 74 through the inlet port 76 and then is discharged rearward through the steering nozzle 86. The rider steers the nozzle 86 by the steering handle bar 56. The watercraft 30 thus moves as the rider desires.

The engine 32 preferably includes a lubrication system that delivers lubricant oil to engine portions for inhibiting frictional wear of such portions. In the illustrated embodiment, a dry-sump lubrication system is employed. This system is a closed-loop type and includes an oil reservoir 270 as illustrated.

An oil delivery pump is provided within a circulation loop to deliver the oil in the reservoir 270 to the engine portions that are to be lubricated, for example, but without limitation, the pistons 94 and crankshaft bearings 106. The delivery pump preferably is driven by the crankshaft 82, as described below, but may alternatively be driven by one of the camshafts 260, 262.

Oil galleries (not shown) are defined in the crankcase member 100, crankshaft bearings 106 and the crankshaft 82 itself. The oil galleries include a plurality of openings which are generally aligned with portions of the engine 32 where lubrication is desirable. The oil is pressurized by the delivery pump to flow through these galleries. Before entering the galleries, the oil passes through an oil filter 276 (FIG. 5) which removes foreign substances from the oil. The oil filter 276 is preferably disposed at a side surface of the engine body 108 on the port side.

The oil comes out and/or is sprayed to the portions from the openings of the galleries. A return pump is also provided in the system to return the oil that has moved down to an inner bottom portion of the crankcase member 100 back to the oil reservoir 270. The return pump preferably is driven by the crankshaft 82. However, the return pump may alternatively be driven by one of the camshafts 260, 262 also.

With reference to FIG. 6, the crankcase member 100 is desirably comprised of an upper crankcase member 280 and a lower crankcase member. The crankcase members are coupled together to define the crankcase chamber 102, as described above. A drive shaft cover member (not shown) is coupled to a rearward end of the crankcase 100 and encloses a reduction gear set between the crankshaft 82 and an output shaft 280.

Specifically, a drive gear 282 is coupled for rotation with a rearward end of the crankshaft 82. The drive gear 282 meshes with a driven gear 284 mounted to a forward end of the output shaft 280.

The output shaft 280 is laterally offset and parallel to the crankshaft 82. The forward end of the output shaft 280 is rotatably supported by the crankcase 100 through a bearing (not shown). Thus, the output shaft 280 is driven by the crankshaft 82 of the engine 32. Preferably, the diameter of the driven gear 284 is larger than the diameter of the drive gear 282. Thus, the gears 282, 284 define a gear reduction set. As such, the rotational speed of the output shaft 280 is less than the rotational speed of the crankshaft 82 during operation. Thus, the engine 32 can be configured to operate at speeds higher than the maximum designed speed of the impeller, i.e., the speed at which the impeller cavitates.

An oil pump drive shaft 286 (FIG. 8) is also laterally offset and parallel to the crankshaft 82. The forward end of the oil pump drive shaft 286 includes a driven gear (not shown) which meshes with and is thereby driven by the drive gear 282. A rearward end of the oil pump drive shaft 286 extends into the oil pump and drives both the delivery pump and the return pump 292. Thus, the delivery and return pump 292 are driven by the crankshaft to the engine to the oil pump drive shaft 286.

With reference to FIG. 8, an oil pump housing 288 and rear oil pump cover 290 are illustrated. Additionally, various internal passages defined at least in part by the oil pump housing 288 and cover 290 are illustrated in phantom.

Specifically, the oil pump body 288 and cover 290 house both the delivery pump and the return pump 292, as well as the passages defining the inlets and outlets of these pumps.

The return pump 292, illustrated in phantom, receives oil collected in the lower portion of the crankcase 100 through an oil return port 294. The oil return port 294 opens into a space within the crankcase configured to pool oil which has passed through the oil galleries within the engine body 108. The pump body 288 and cover 290 also define an oil collection space 296 which is configured to pool oil received from the crankcase 100. A pump feed port 298 connects the space 296 with the inlet to the return pump 292.

The outlet of the return pump 292 connects to an oil discharge port 300. The oil discharge port 300 connects with a return passage 302. The return passage 302 also connects with a staging portion 304 of the oil reservoir 270, described in greater detail below.

As noted above, the oil pump shaft 286 also rotatably drives an oil delivery pump (not shown). In the illustrated embodiment, the oil delivery pump is disposed forwardly from the return pump 292. The pump body 288 defines a delivery pump supply passage 306. The supply passage 306 is connected to an outlet 308 of the reservoir 270. At its downstream end, the supply passage 306 is connected to a supply port 310. The supply port 310 is connected to the inlet of the delivery pump.

The outlet of the delivery pump is connected to a discharge port 312. The discharge port 312 connects to a delivery passage 314, which in turn, is connected to the various oil galleries defined within the engine body 108.

In operation, as the crankshaft 82 drives the oil pump shaft 286, both oil pumps, including the oil delivery pump and the oil return pump 292 are also driven. Oil that is already circulated through the engine body 108 flows from the crankcase 100 through the port 294. The oil flows into the collection space 296 and is thus drawn through the port 298 into the inlet of the return pump 292. The pump 292 discharges the oil to the discharge port 300 and upwardly into the staging 304 within the reservoir 270. After the oil has circulated through the reservoir 270, it pools in the lower portion of the reservoir 270 adjacent the outlet 308.

Because the delivery pump is also driven by the oil pump shaft 286, the delivery pump draws oil from the outlet port 308, through the supply port passage 306 and through the port 310 to the inlet of the delivery pump. The oil fed into the delivery pump is then discharged through the outlet of the delivery pump and to the discharge port 312. The oil from the outlet port 312 then flows through the passage 314 to the various oil galleries defined within the engine body. Preferably, the return pump 292 is configured to have a greater pumping capacity (i.e., a higher flow rate) than the delivery pump so that oil is returned to the reservoir 70 at least as quickly as it is withdrawn by the delivery pump.

Figure 9:
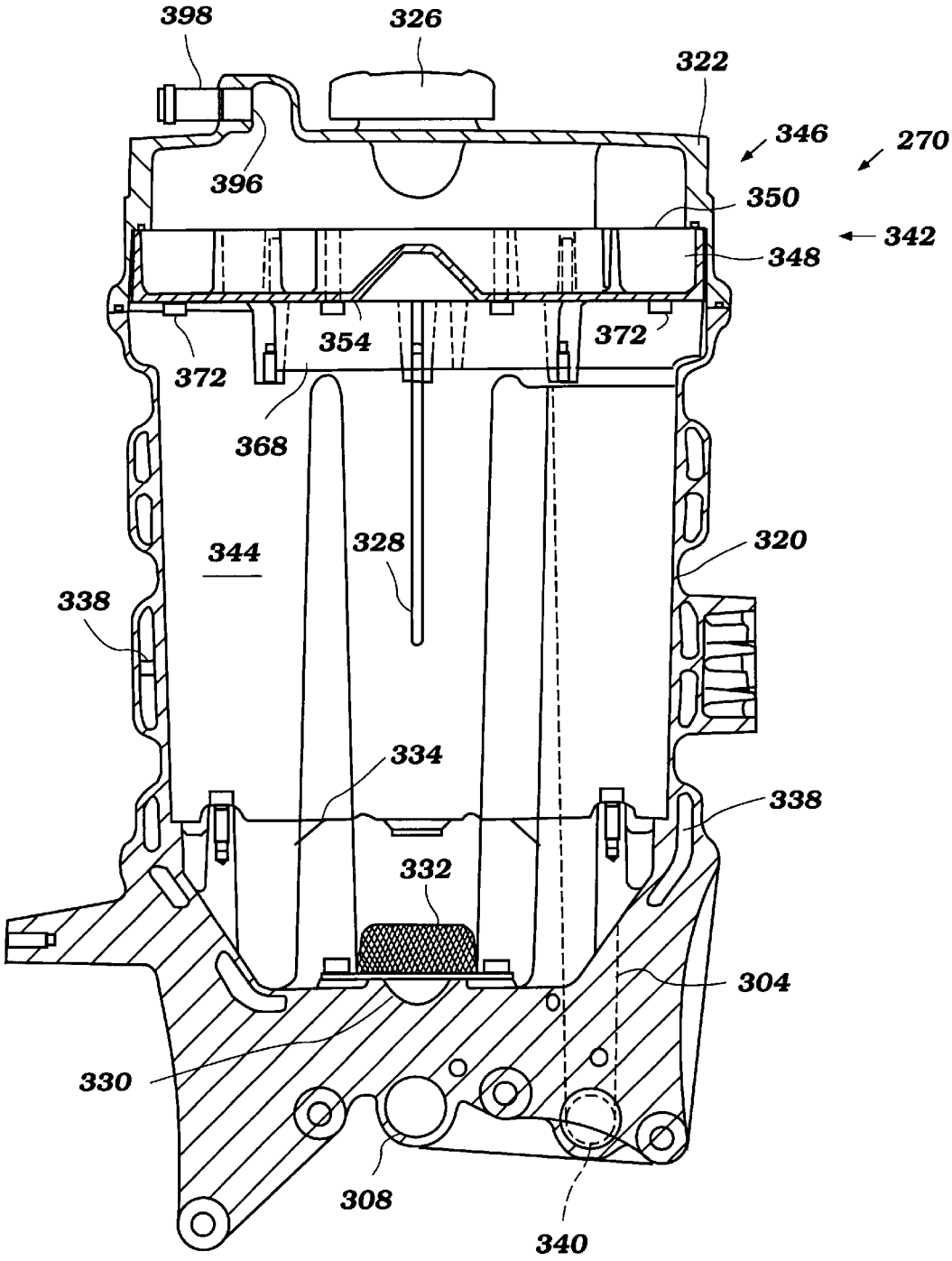
FIG. 9 is a sectional view of the lubricant reservoir shown in FIG. 4, taken along the line 9—9, showing a baffle assembly disposed in an upper portion of the reservoir.
Figure 10:
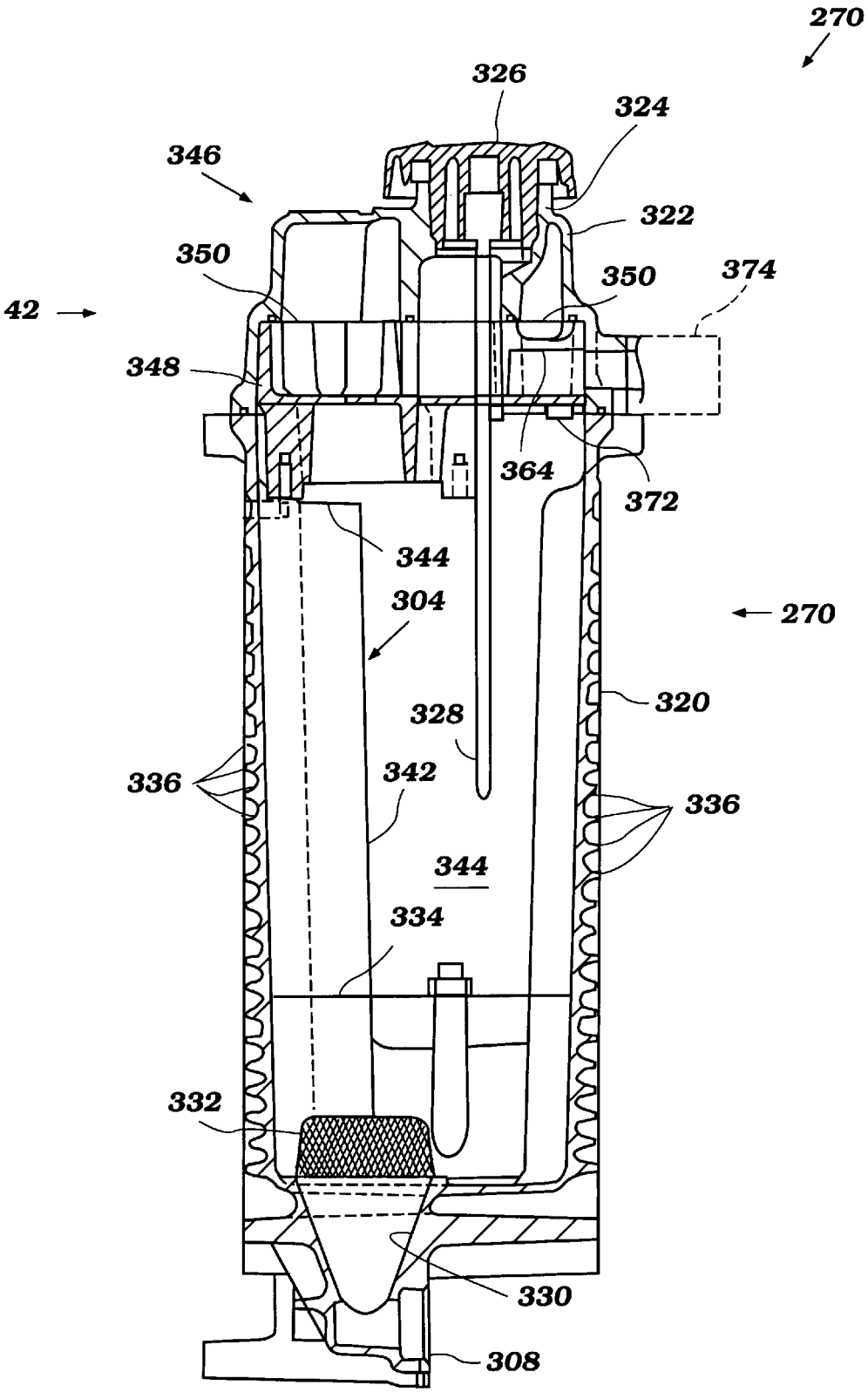
FIG. 10 is a sectional view of the lubricant reservoir shown in FIG. 4, taken along line 10—10.

With reference to FIGS. 9 and 10, the reservoir 270 includes a reservoir body 320 which primarily forms the lubricant reservoir therein. The upper end of the reservoir body 320 is open. A lid 322 of the reservoir 270 closes the upper open end of the body 320.

The lid 322 defines an opening 324, through which oil may be added to the reservoir 320. A cap 326 normally closes the opening 324 and includes a fluid level indicator 328, also known as a "dipstick."

The reservoir body 320, as noted above, defines an internal volume of space which primarily serves as the oil reservoir. A lower end of the body 320 includes an outlet portion 330. Preferably, the outlet portion 330 has steeply slanted walls. The lower end of the outlet portion 330 connects to the discharge port 308, through which oil is supplied to the delivery pump, as noted above.

A screen 332 is mounted over the upper end of the outlet portion 330. The screen is configured to prevent large foreign particles from reaching the delivery pump.

Above the outlet portion 330 and the screen 332, the baffle 334 is mounted. The baffle 334 preferably includes a plurality of apertures which allow oil from the upper portion of the reservoir to flow toward the outlet portion 330. Additionally, the baffle 334 aids in keeping the outlet portion 330 completely submerged in oil during operation. For example, during vigorous movements of the watercraft 30, the baffle 334 slows the upward flow of lubricant.

The body 320 also defines, at least in part, a plurality of cooling jackets that are configured to be in thermal communication with oil stored within the body 320. For example, on the forward and rearward sides of the body 320, a plurality of cooling fins 336 are formed. Forward and rearward cooling jacket caps (not shown) cooperate with the forward and rearward surfaces of the body 320 and the cooling fins 336 so as to define cooling passages. Additionally, the body 320 defines transverse coolant passages 338 which fluidically connect the cooling passages defined on the forward and rearward sides of the body 320. The cooling passages defined by the fins 336, the coolant jacket caps, and the passages 338, can be fed with cooling water from the body of water in which the watercraft 30 operates.

As noted above, the body 320 also includes the staging area 304. The staging area 304 communicates with the return passage 302 (FIG. 8) through a return port 340. Preferably, the staging area is defined by an interior vertical wall 342 which extends from the bottom surface of the body 320 towards an upper end of the body 320.

A spillway 344 is defined at the upper end of the vertical wall 342. Thus, during operation, as oil is supplied through the return port 340 and upwards into the staging area 304, the oil remains in the staging area until the level of the oil reaches the spillway 344. After the oil reaches the spillway 344, the oil spills over into the main portion of the reservoir defined by the body 320. Preferably, the interior of the staging area 304 is in thermal communication with one of the forward and rearward side cooling jackets. Thus, oil initially entering the body 320 is kept in contact with the cooling jackets, and thus cooled before leaving the reservoir through the outlet portion 330.

The lid 332 of the reservoir 270 defines a portion of a vapor recovery system. A baffle assembly 342 is mounted to the lid 322 so as to divide the interior of the reservoir body 270 into a main lubricant storage portion 344 and a breather portion 346. In the illustrated embodiment, the baffle assembly 342 is comprised of a lower baffle member 348 and upper baffle member 350.

Figure 11:
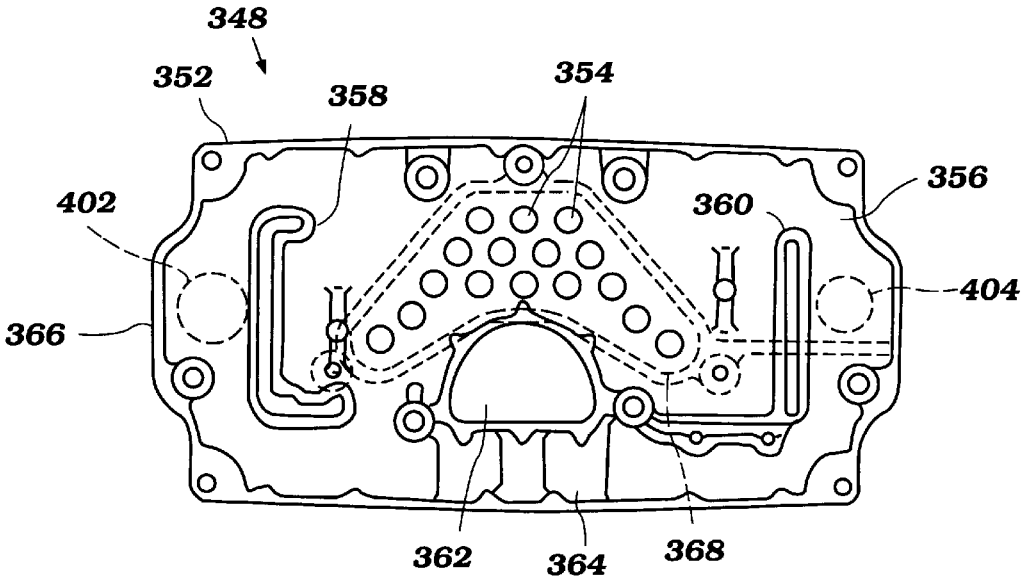
FIG. 11 is a top plan view of a second portion of the baffle assembly shown in FIG. 9.
Figure 12:
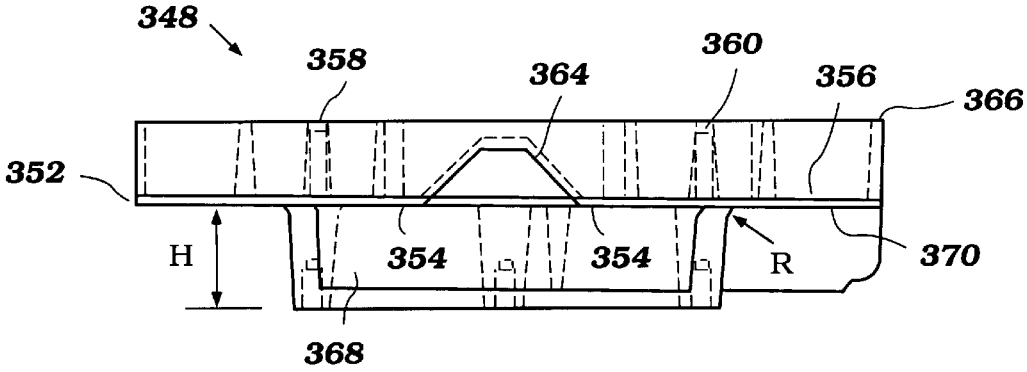
FIG. 12 is an elevational view of the baffle assembly plate shown in FIG. 11.
Figure 13:
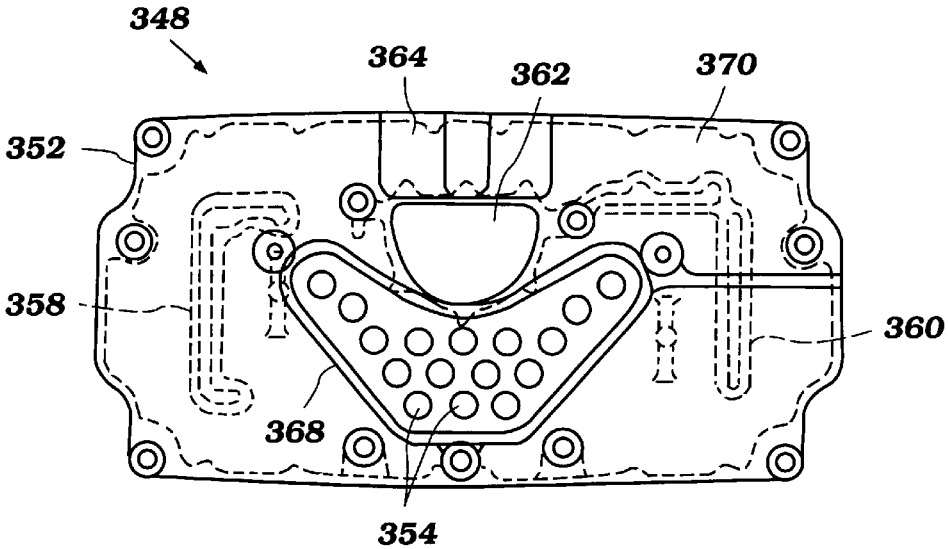
FIG. 13 is a bottom plan view of the baffle assembly plate illustrating in FIG. 11.

With reference to FIGS. 11–13, the lower baffle member 348 includes a main body member 352 that is generally rectangular in top plan view (FIG. 11). At the center of the rectangular body 352, the baffle member 348 includes at least one aperture 354. Preferably, the baffle plate member 348 includes a plurality of apertures 354 disposed at approximately a central area thereof. In the illustrated embodiment, the apertures are round and are arranged within a triangular area and central portion of the body member 352. More specifically, the apertures 354 are arranged in a boomerang-shaped area.

As shown in FIG. 11, an upper surface 356 of the body 352 includes two walls 358, 360 standing vertically relative to the upper surface 356. The walls 358, 360 are disposed on opposite lateral sides of the arrangement of apertures 354.

As shown in FIGS. 11 and 13, the body 352 also includes an oil refill aperture 362 disposed near a central area of the body 352. The aperture 362 is generally aligned with the aperture 324 (FIG. 10), through which oil can be poured to refill the reservoir 270.

With reference to FIG. 12, the body 352 also includes a recess portion 364. The recess portion 364 is convex on the upper surface 356. Discussed in greater detail below, the recess portion 364 allows another conduit to communicate with the main reservoir portion 344.

With reference to FIGS. 11 and 12, the body 352 also includes an outer peripheral wall 366 which extends around the outer periphery of the body 352. The height of the walls 358, 360, 366 are substantially the same. Thus, the upper surface 356 of the body 352, within the outer peripheral wall 366, defines a recessed area on the upper surface of the body 352.

With reference to FIGS. 12 and 13, the body 352 also includes a skirt 368 which extends around the apertures 354. The skirt 368 extends downwardly from a lower surface 370 of the body 352. The skirt 368 extends downwardly from the lower surface 370 a predetermined Height. As shown in FIG. 12, a radius R preferably is formed at the intersection between the skirt 368 and the lower surface 370.

Figure 14:
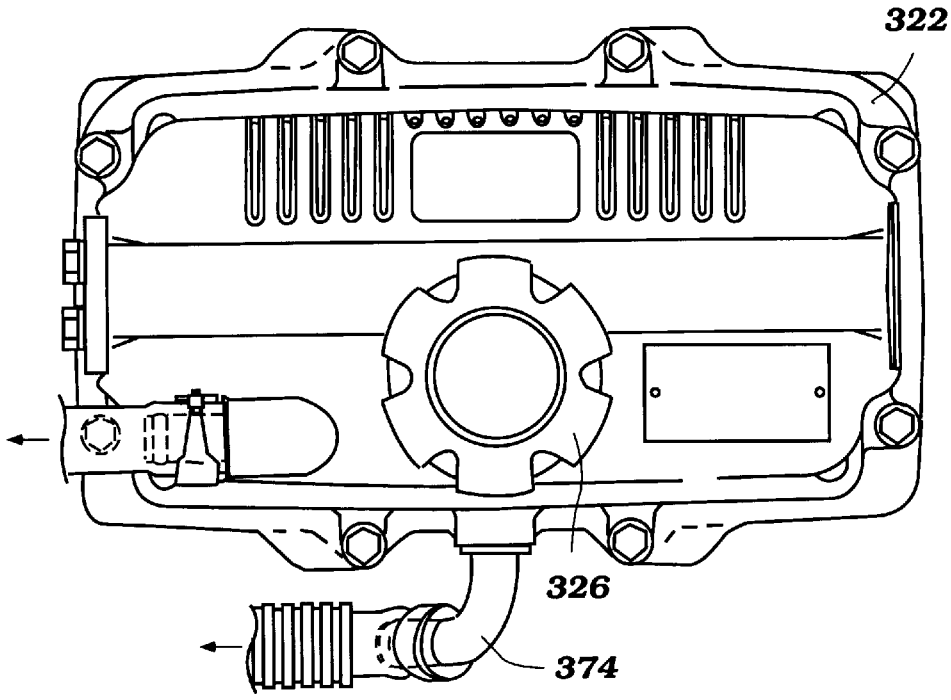
FIG. 14 is a top plan view of the lubricant reservoir shown in FIG. 4.
Figure 15:
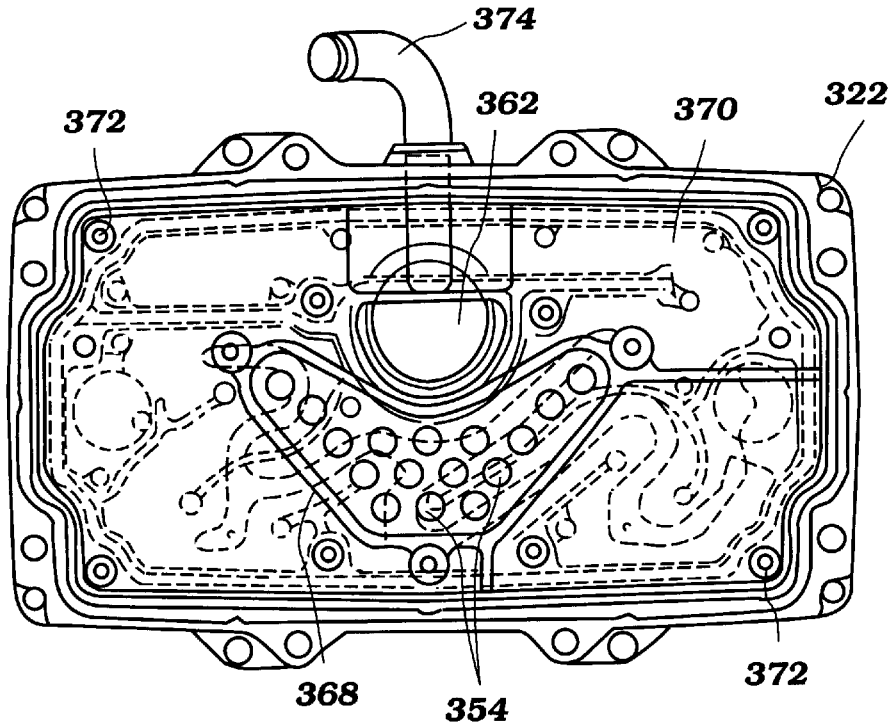
FIG. 15 is a bottom plan view of the lid of the lubricant reservoir show in FIG. 14, having the baffle assembly of in FIG. 9, attached to the bottom of the lid.

With reference to FIGS. 14 and 15, the baffle member 348 is connected to an inner surface of the lid 322 by a plurality of bolts 372. As noted above, a conduit 374 connects the reservoir 270 with the interior of the cylinder head 96. As shown in FIG. 10, the conduit 374 extends through a side of the lid 322 to a space beneath the recessed portion 364. Thus, the conduit 374 communicates with the main reservoir portion 344. If the main reservoir portion overflows, overflow oil can flow through the conduit 374 back to the cylinder head. Such oil can eventually return to the crankcase and be recirculated through the lubrication system. Additionally, because the conduit 374 is connected to the head 96 of the engine 32, blow-by gases within the engine body can be guided to the main reservoir portion 344.

With reference to FIG. 9, the upper baffle member 350 is disposed between the lower baffle member 348 and the lid 322. The bolts 372 extend through the lower baffle member 348 into the lid 322 and thereby secure the upper baffle member 350 therebetween.

FIG. 15 illustrates a bottom plan view of the lid 322 with the upper and lower baffle members 350, 348 mounted therein. The features on the lower face of the lower baffle member 348 are illustrated in solid line. The features on the upper portion of the lower baffle member 348 are not shown. Surface features on the upper baffle member 350 and an inner surface of the lid 322 are shown in phantom.

Figure 16:
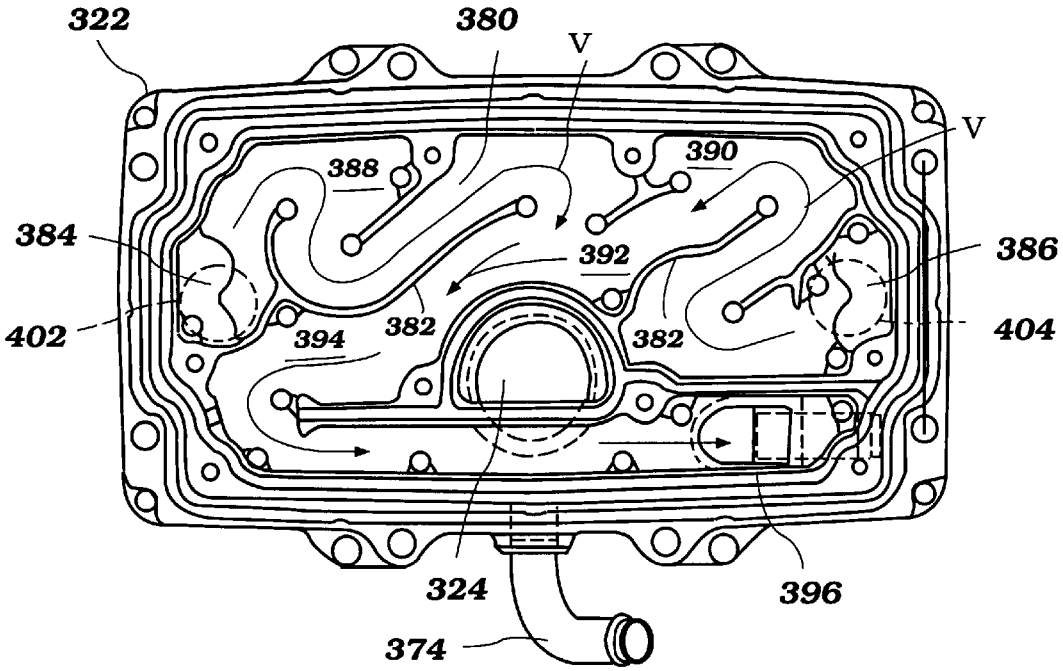
FIG. 16 is a bottom plan view of the lid shown in FIG. 15, with the baffle assembly removed.

FIG. 16 illustrates, in solid line, the surface features of the inner surface 380 of the lid 322. The lid 322 includes a plurality of guidewalls 382 extending downwardly from the inner surface 380. The walls 382 are configured to cooperate with the upper baffle member 350 so as to define a labyrinth path for vapor V to follow during operation. The walls 382 define two inlet portions 384, 386 on the port and starboard sides, respectively. Further, the walls 382 define two vapor pathways 388, 390, extending from the inlet portions 384, 386, respectively. The pathways 388, 390 extend from the inlet portions 384, 386 towards a central portion of the lid 322. At a central portion of the lid 322, the pathways 388, 390 merge at a merging portion 392.

The walls 382 further define a discharge path extending from the merging portion 392 toward a discharge outlet 396. With reference to FIG. 9, the discharge aperture 396 is connected with a nipple 398. The nipple 398 is connected with a vapor conduit which extends to the inlet port 200 (FIG. 5). Thus, vapor V from the lid 322 can be returned to the induction system, described in greater detail below.

Figure 17:
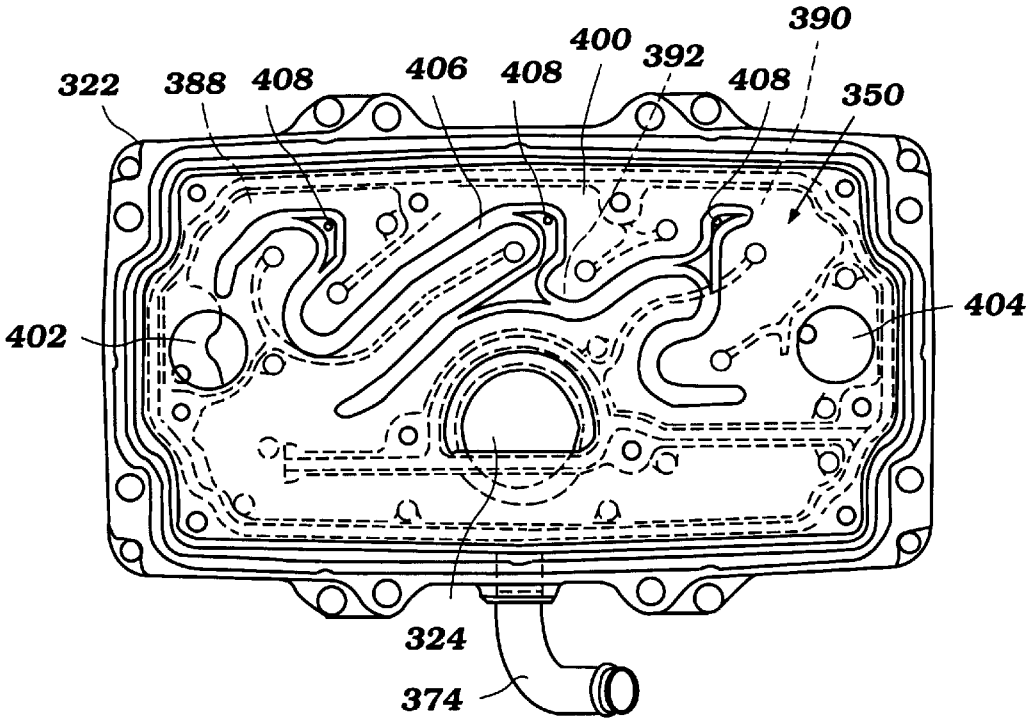
FIG. 17 is a bottom plan view of the lid shown on FIG. 15 with one plate of the baffle assembly installed.

With reference to FIG. 17, the lid 322 is illustrated with the upper baffle member 350 disposed over the inner surface 380 of the lid 322. Surface features of the upper baffle plate 350 are shown in solid line. The surface features of the inner surface 380 of the lid 322 are shown in phantom.

The upper baffle member 350 is formed with a generally rectangular body 400. The body 400 has a shape that is generally complimentary to a recess formed in the lid 322.

At its lateral ends, the body 400 includes apertures 402, 404. As shown in FIG. 16, the apertures 402, 404 are substantially aligned with the inlet portions 384, 386 defined by the walls 382 on the lid 322.

The body 400 also includes a recess 406 on its upper surface. In the illustrated embodiment, the body 400 is made from a thin material. Thus, the recess 406 on the upper surface of the body 400 is convex on the lower surface of the body 400.

The recess portion 406 extends substantially along the pathways 388, 390 defined by the walls 382 of the lid 322. The recess 406 on the upper surface of the body 400 is concave. Thus, the recess 406 forms a trough that extends substantially along the pathways 388, 390. Additionally, the recess 406 extends through the merging portion 392 and along at least a portion of the discharge passage 394.

The recess portion 406 also includes at least one aperture 408. Preferably, the recess 406 includes three apertures 408, one along the bottom surface of each of the pathways 388, and 390. Additionally, one of the apertures 408 is adjacent the merging portion 392.

With reference to FIG. 11, the apertures 402, 404 are shown in phantom to illustrate the alignment between the apertures 402, 404 and the walls 358, 360 of the lower baffle member 348.

During operation, blow-by gases and air within the engine body 108 become entrained within the lubricant circulating within the engine body 108. As the lubricant is drawn from the engine body 108 through the return pump 286, the lubricant with blow-by gases and/or air entrained therein is delivered into the main portion 344 of the reservoir 270. The air and/or air fuel mixture or "blow-by gases" that have been entrained within the lubricant, aspirate out and collect in a space above the level of liquid lubricant L within the main reservoir portion 344.

The air and/or blow-by gases V that aspirate out of the lubricant L within the main lubricant portion 344 pass upwardly through the apertures 354 defined in the lower baffle member 348.

With reference to FIG. 11 (showing a top plan view of the lower baffle member 348) as the gases move upwardly through the apertures 354, they enter a central portion of the baffle assembly 346 defined between the upper and lower baffle members 350, 348. Further, the central area is disposed between the walls 358 and 360 defined on the upper surface 356 of the body 352. Thus, the gases must travel around the walls 358, 360 to reach the apertures 402, 404 disposed in the upper baffle member 350.

With reference to FIG. 16, as the vapor V travels through the apertures 402, 404, the vapor V flows along the guidepaths 388, 390 defined by the walls 382 of the lid 322. Eventually, the vapor V flows travelling along the paths 388, 390 merge at the merging portion 392. From the merging portion 392, the vapor V flows to a discharge path 394 and eventually out of the discharge 396.

As the vapor V travels along the paths 388, 390, 392, 394, droplets of lubricant oil precipitate out of the vapor V and fall onto the upper surface of the upper baffle member 350. As noted above, the upper surface of the upper baffle member 450 includes the recess 406 which extends substantially along portions of the pathways 388, 390, 392, 394. Thus, as liquids precipitate out of the vapor V, the liquids collect in the recess 406 and then subsequently drain through the apertures 408. Liquids that drain through the apertures 408 fall onto the upper surface 356 of the lower baffle member 348, and thus can return to the main portion 344 of the reservoir 270 through the apertures 354 in the lower baffle member 348.

Figure 18:
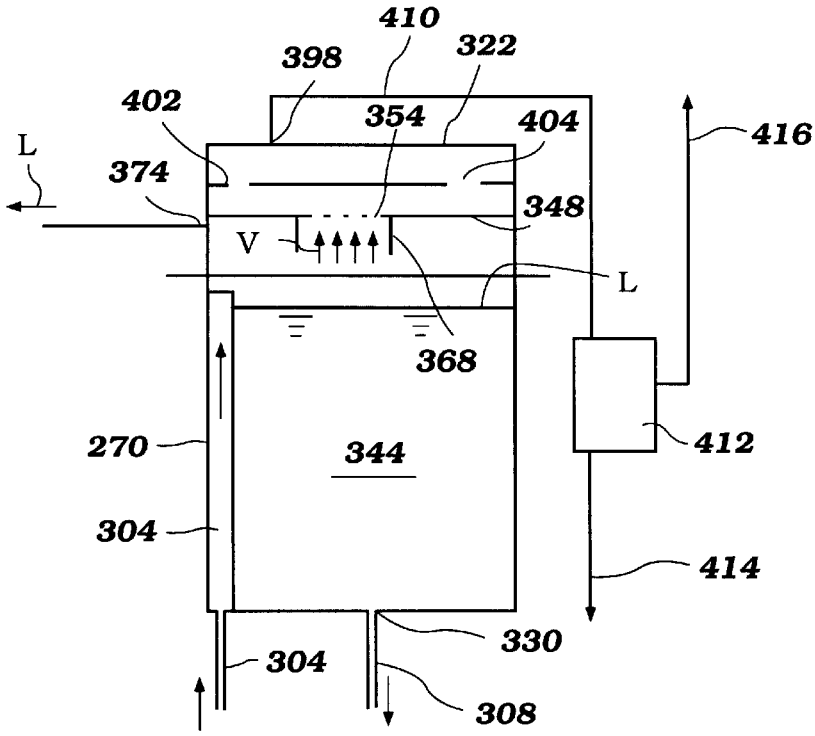
FIG. 18 is a schematic illustration of the lubricant reservoir and breather assembly included in the watercraft shown in FIG. 4.

With reference to FIG. 18, a vapor recovery conduit 410 extends from the nipple 398 to an additional vapor separation device 412. Preferably, the vapor separation device 412 includes an interior wall that defines a labyrinth path. A drain conduit 414 extends from a lower surface of the device 412 to the engine body 108. Additionally, a vapor return conduit 416 extends from the device 412 to the inlet port 200 (FIG. 5).

In operation, as vapor V leaving the nipple 398 travels through the vapor recovery line 410, the vapor V travels through the labyrinth path defined within the separator device 412. Additional liquid lubricant L that is separated from the vapor V is returned to the crankcase through the conduit 414. After the vapor V travels through the separation device 412, the blow-by gases and/or air V are returned to the induction system through the conduit 416 to be combusted with induction air within the engine 32.

Figure 19:
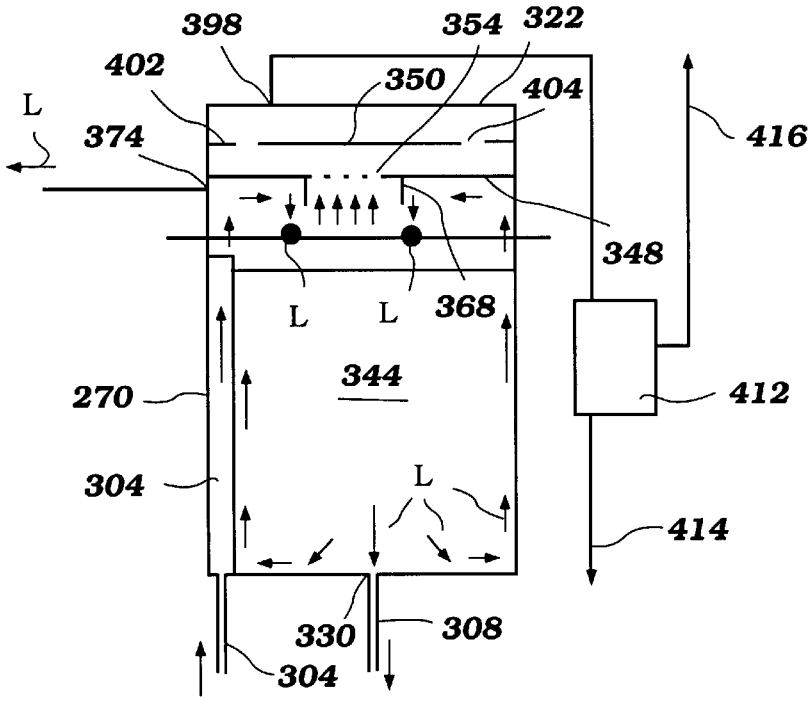
FIG. 19 is a schematic illustration of the lubricant reservoir and vapor recovery assembly shown in FIG. 18, with arrows indicating movement of liquid lubricant within the reservoir during planing and/or high speed turns.

During normal low speed operation of the watercraft 30, the liquid lubricant L within the reservoir 270 remains substantially level. However, with reference to FIG. 19, when the watercraft 30 is operated at higher planing speeds and/or through sharp turns, lubricant L within the reservoir 270 can be agitated violently. In particular, the lubricant L can be caused to flow upwardly along the sides of the main reservoir portion 344 and flow into contact with the lower surface of the lower baffle member 348.

As the lubricant L reaches the lower surface of the lower baffle member 348, it turns inwardly. Thus, by providing a skirt 368 which extends downwardly from the lower surface of the lower baffle member 348 and generally surrounding the apertures 354, the flow of lubricant L can be diverted back downwardly away from the apertures 354. Thus, less liquid lubricant L is likely to pass upwardly through the apertures 354 into the baffle arrangement 346.

Of course, the foregoing description is that of preferred embodiments of the present invention, and various changes and modifications may be made without departing from the spirit and scope of the invention, as defined by the appended claims.

What is claimed is:

1. A watercraft comprising a hull including a lower portion and an upper portion, an engine compartment defined between the upper and lower portions, a four-cycle internal combustion engine supported within the engine compartment, the engine including an engine body defining at least one combustion chamber therein, and a valve train comprising at least one intake valve configured to control air flow into the combustion chamber and at least one exhaust valve configured to control flow of exhaust gases out of the combustion chamber, an induction system configured to guide air to the engine body, a crankshaft journaled for rotation at least partially within the engine body, a plurality of oil galleries defined within the engine body configured to guide oil to at least portions of the valve train and the crankshaft, an oil reservoir having a removable lid, an oil pump arrangement configured to circulate oil between the reservoir and the oil galleries, and a breather baffle arrangement connected to the lid, the baffle arrangement comprising at least upper and lower baffle members, each baffle member having at least one gas aperture configured to allow a gas to pass therethrough, a vapor outlet disposed in the lid and positioned such that vapor from the interior of the reservoir must pass through the baffle arrangement in order reach the vapor outlet, and a skirt extending downwardly from a lower surface of the lower baffle member, the skirt extending around a periphery of the aperture in the lower baffle member.

2. The watercraft according to claim 1, wherein the upper baffle includes two apertures, the aperture on the lower baffle member being offset from the two apertures in the upper baffle member.

3. The watercraft according to claim 2, wherein the lower baffle includes two walls extending upwardly from an upper surface of the lower baffle member, each wall being disposed between the aperture in the lower baffle member and one of the apertures in the upper baffle member.

4. The watercraft according to claim 1, wherein the lower baffle member including an arrangement of plural apertures, the skirt extending around a periphery of the arrangement.

5. A watercraft comprising a hull, an engine having an engine body supported by the hull, a lubricant reservoir defining an interior portion disposed outside of the engine body and configured to pool lubricant for the engine, the reservoir having a removable lid having a vapor outlet, and a breather baffle arrangement disposed between the interior portion and the vapor outlet, the baffle arrangement comprising a lower wall and at least one aperture on a lower surface thereof, and a wall extending downwardly from an upper wall of the lid to the lower wall, and extending between the outlet and the aperture.

6. The watercraft according to claim 5, wherein the reservoir comprises a housing, the baffle arrangement being sealed to the housing around a periphery of the vapor outlet, such that vapor from the interior of the reservoir must pass through the baffle arrangement before reaching the vapor outlet.

7. The watercraft according to claim 5, wherein the baffle arrangement includes an arrangement of plural apertures on the lower surface, the wall extending around a periphery of the arrangement.

8. The watercraft according to claim 5, wherein the reservoir comprises a removable lid, the baffle arrangement being connected to the lid.

9. A watercraft comprising a hull, an engine supported by the hull, a lubricant reservoir defining an interior portion configured to pool lubricant for the engine, the reservoir having a vapor outlet, and a breather baffle arrangement disposed between the interior portion and the vapor outlet, the baffle arrangement comprising at least one aperture on a lower surface thereof, and a wall extending downwardly from the lower surface, and extending between the outlet and the aperture, wherein the baffle arrangement comprises at least upper and lower baffle members.

10. The watercraft according to claim 9, wherein the baffle members are sealedly engaged with each other around a periphery thereof.

11. The watercraft according to claim 9, wherein the baffle members are sealedly engaged with each other around a periphery thereof.

12. A watercraft comprising a hull, an engine supported by the hull, a lubricant reservoir defining an interior portion configured to pool lubricant for the engine, the reservoir having a vapor outlet, and a breather baffle arrangement disposed between the interior portion and the vapor outlet, the baffle arrangement comprising at least one aperture on a lower surface thereof, a wall extending downwardly from the lower surface, and extending between the outlet and the aperture, an oil inlet to the reservoir, an oil outlet of the reservoir, an oil pump arrangement configured to deliver oil to the inlet of the reservoir and to receive oil from the outlet of the reservoir, a second baffle disposed in the interior of the reservoir and positioned between the inlet and the outlet such that oil entering the inlet of the reservoir must pass through the baffle before flowing to the outlet of the reservoir.

13. A watercraft comprising a hull, an engine supported by the hull, a lubricant reservoir defining an interior portion configured to pool lubricant for the engine, the reservoir having a vapor outlet, and a breather baffle arrangement disposed between the interior portion and the vapor outlet, the baffle arrangement comprising at least one aperture on a lower surface thereof, and a wall extending downwardly from the lower surface, and extending between the outlet and the aperture, wherein the baffle arrangement comprises at least upper and lower baffle members.

* * * * *